US009267736B2

(12) United States Patent
Bayley et al.

(10) Patent No.: US 9,267,736 B2
(45) Date of Patent: Feb. 23, 2016

(54) HAND DRYER WITH POINT OF INGRESS DEPENDENT AIR DELAY AND FILTER SENSOR

(75) Inventors: Graeme S. Bayley, Brookfield, WI (US); Mark A. Figurski, Hartland, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 1011 days.

(21) Appl. No.: 13/267,429

(22) Filed: Oct. 6, 2011

(65) Prior Publication Data

US 2013/0086741 A1 Apr. 11, 2013

Related U.S. Application Data

(63) Continuation-in-part of application No. 13/088,512, filed on Apr. 18, 2011, now Pat. No. 9,170,148.

(51) Int. Cl.

| | |
|---|---|
| ***A47K 4/00*** | (2006.01) |
| ***F26B 21/12*** | (2006.01) |
| ***A47K 10/48*** | (2006.01) |

(52) U.S. Cl.

CPC . *F26B 21/12* (2013.01); *A47K 4/00* (2013.01); *A47K 10/48* (2013.01); *A47K 2210/00* (2013.01)

(58) Field of Classification Search

CPC ..... A47K 10/48
USPC ..... 4/623
See application file for complete search history.

(56) References Cited

U.S. PATENT DOCUMENTS

| | | | |
|---|---|---|---|
| 540,235 | A | 6/1895 | Clifford et al. |
| D30,136 | S | 2/1899 | Eckerson |
| D35,574 | S | 1/1902 | Thielke |
| D36,574 | S | 10/1903 | Zipp |
| D36,575 | S | 10/1903 | Zipp |
| D36,595 | S | 10/1903 | Peet |
| 937,509 | A | 10/1909 | Carpenter |
| 1,069,972 | A | 8/1913 | Metzaer |
| 1,323,398 | A | 12/1919 | Leland |
| 1,419,712 | A | 6/1922 | Bassette |
| 1,423,800 | A | 7/1922 | Hibbard et al. |
| 1,494,883 | A | 5/1924 | Bassette et al. |

(Continued)

FOREIGN PATENT DOCUMENTS

| | | |
|---|---|---|
| AT | 141398 | 8/1995 |
| AU | 2005203363 A1 | 2/2006 |

(Continued)

OTHER PUBLICATIONS

U.S. Appl. No. 29/306,946, filed Oct. 2, 2008, Thielke et al.

(Continued)

*Primary Examiner* — Janie Christiansen
(74) *Attorney, Agent, or Firm* — Boyle Fredrickson, S.C.

(57) ABSTRACT

A lavatory system includes a hand dryer with at least a first proximity sensor and a second proximity sensor to detect an object for drying. A controller is communicatively linked to the first and second proximity sensors. The controller activates a drying operation after a first delay period if the first proximity sensor first detects the object for drying and activates a drying operation after a second delay period if the second proximity sensor first detects the object for drying. A filter flow sensor may also be provided to ensure proper filtering of the dryer's air.

17 Claims, 25 Drawing Sheets

(56) References Cited

U.S. PATENT DOCUMENTS

| | | | |
|---|---|---|---|
| 1,578,047 | A | 3/1926 | Lum |
| 1,579,705 | A | 4/1926 | Hewitt |
| 1,616,313 | A | 2/1927 | Farmer |
| 1,659,851 | A | 2/1928 | Brewington |
| 1,750,094 | A | 3/1930 | Emmrich |
| 1,765,915 | A | 6/1930 | Haase |
| D81,754 | S | 8/1930 | Mabee |
| 1,816,055 | A | 7/1931 | Pfeifer |
| 2,008,183 | A | 2/1934 | McCord |
| 1,961,179 | A | 6/1934 | Tinkham |
| 2,027,605 | A | 1/1936 | McCord et al. |
| 2,041,352 | A | 5/1936 | Jordan |
| D100,310 | S | 7/1936 | Blu |
| 2,130,196 | A | 9/1938 | Sakier |
| 2,192,383 | A | 3/1940 | Krolop |
| 2,202,107 | A | 5/1940 | Korn |
| 2,281,370 | A | 4/1942 | Morrison et al. |
| 2,328,129 | A | 8/1943 | Earle |
| 2,438,762 | A | 3/1948 | McLeckie |
| 2,470,187 | A | 5/1949 | Price |
| 2,479,571 | A | 8/1949 | Hewitt |
| 2,498,699 | A | 2/1950 | Mullett et al. |
| 2,504,740 | A | 4/1950 | Siegel |
| 2,521,769 | A | 9/1950 | Arcularius |
| 2,537,821 | A | 1/1951 | Fodor |
| 2,591,669 | A | 4/1952 | Bucknell et al. |
| 2,606,274 | A | 8/1952 | Spierer |
| RE23,674 | E | 6/1953 | Spierer et al. |
| 2,641,679 | A | 6/1953 | Brodbeck |
| 2,646,629 | A | 7/1953 | Clemens |
| D170,204 | S | 8/1953 | Long |
| 2,651,705 | A | 9/1953 | Clemens |
| 2,666,837 | A | 1/1954 | Brodbeck |
| 2,677,041 | A | 4/1954 | Oliver et al. |
| 2,698,894 | A | 1/1955 | Stein |
| 2,714,151 | A | 7/1955 | Becker |
| 2,761,222 | A | 9/1956 | Bennett |
| 2,767,407 | A | 10/1956 | Weiss |
| 2,777,934 | A | 1/1957 | Falkenthal |
| 2,826,763 | A | 3/1958 | Bass |
| 2,837,835 | A | 6/1958 | Hewitt et al. |
| 2,853,591 | A | 9/1958 | Fine |
| 2,853,592 | A | 9/1958 | Gravet |
| 2,859,535 | A | 11/1958 | Carlson |
| 2,906,627 | A | 9/1959 | Payton et al. |
| 2,908,019 | A | 10/1959 | Lyon, Jr. |
| 2,965,906 | A | 12/1960 | Mullett et al. |
| 2,977,455 | A | 3/1961 | Murphy |
| 3,059,815 | A | 10/1962 | Parsons, Jr. |
| 3,065,473 | A | 11/1962 | Sporck et al. |
| 3,076,887 | A | 2/1963 | Bulow |
| 3,128,161 | A | 4/1964 | Hudon |
| D201,493 | S | 6/1965 | Sundberg et al. |
| 3,220,424 | A | 11/1965 | Nelson |
| 3,305,938 | A | 2/1967 | Arthur |
| D210,131 | S | 2/1968 | Rourke |
| 3,384,977 | A | 5/1968 | Rosenberg |
| 3,409,995 | A | 11/1968 | Greenwood et al. |
| 3,415,278 | A | 12/1968 | Yamamoto et al. |
| 3,449,838 | A | 6/1969 | Chancellor |
| 3,480,787 | A | 11/1969 | Johansen |
| 3,487,477 | A | 1/1970 | Classen |
| 3,491,381 | A | 1/1970 | Catheart |
| 3,502,384 | A | 3/1970 | Gipson |
| 3,505,692 | A | 4/1970 | Forbes |
| 3,523,305 | A | 8/1970 | Zom |
| 3,536,294 | A | 10/1970 | Rodriguez |
| 3,551,919 | A | 1/1971 | Forbes |
| 3,556,158 | A | 1/1971 | Schneider |
| 3,575,583 | A | 4/1971 | Brown |
| 3,575,640 | A | 4/1971 | Ishikawa |
| 3,576,277 | A | 4/1971 | Blackmon |
| 3,585,652 | A | 6/1971 | Forbes et al. |
| 3,585,653 | A | 6/1971 | Forbes et al. |
| 3,587,177 | A | 6/1971 | Overly et al. |
| 3,588,038 | A | 6/1971 | Tanaka |
| 3,603,002 | A | 9/1971 | Spierer |
| 3,613,124 | A | 10/1971 | Ichimori et al. |
| 3,621,199 | A | 11/1971 | Goldstein |
| 3,639,920 | A | 2/1972 | Griffin et al. |
| 3,643,346 | A | 2/1972 | Lester |
| 3,699,984 | A | 10/1972 | Davis |
| 3,724,001 | A | 4/1973 | Ichimori et al. |
| 3,744,149 | A | 7/1973 | Helbling |
| 3,746,035 | A | 7/1973 | Singer |
| 3,757,806 | A | 9/1973 | Bhaskar et al. |
| 3,817,651 | A | 6/1974 | Law et al. |
| 3,878,621 | A | 4/1975 | Duerre |
| 3,904,167 | A | 9/1975 | Touch et al. |
| 3,906,795 | A | 9/1975 | Kask |
| 3,918,987 | A | 11/1975 | Kopfer |
| D238,075 | S | 12/1975 | Harris |
| 3,975,781 | A | 8/1976 | Klimboff et al. |
| 3,992,730 | A | 11/1976 | Davis |
| 4,072,157 | A | 2/1978 | Wines, Jr. et al. |
| 4,120,180 | A | 10/1978 | Jedora |
| 4,144,596 | A | 3/1979 | MacFarlane et al. |
| 4,145,602 | A | 3/1979 | Lee |
| 4,145,769 | A | 3/1979 | MacFarlane et al. |
| D251,795 | S | 5/1979 | McCann |
| 4,193,209 | A | 3/1980 | Lovison et al. |
| 4,195,416 | A | 4/1980 | Hall |
| 4,219,367 | A | 8/1980 | Cary, Jr. et al. |
| 4,239,555 | A | 12/1980 | Scharlack et al. |
| 4,256,133 | A | 3/1981 | Coward et al. |
| D260,678 | S | 9/1981 | Hiller |
| 4,295,233 | A | 10/1981 | Hinkel et al. |
| 4,309,781 | A | 1/1982 | Lissau |
| 4,336,619 | A | 6/1982 | Hinkel et al. |
| 4,375,847 | A | 3/1983 | Leotta et al. |
| 4,383,377 | A | 5/1983 | Crafton |
| 4,398,310 | A | 8/1983 | Lienhard |
| 4,402,095 | A | 9/1983 | Pepper |
| 4,402,331 | A | 9/1983 | Taldo et al. |
| D272,263 | S | 1/1984 | Lienhard |
| 4,429,422 | A | 2/1984 | Wareham |
| 4,453,286 | A | 6/1984 | Wieland |
| 4,461,439 | A | 7/1984 | Rose |
| 4,497,999 | A | 2/1985 | Postbeschild |
| 4,509,543 | A | 4/1985 | Livingston et al. |
| D279,404 | S | 6/1985 | Hiller |
| 4,520,516 | A | 6/1985 | Parsons |
| 4,541,563 | A | 9/1985 | Uetsuhara |
| 4,570,823 | A | 2/1986 | Arabian et al. |
| 4,594,797 | A | 6/1986 | Houck |
| 4,598,726 | A | 7/1986 | Pepper |
| 4,604,764 | A | 8/1986 | Enzo |
| 4,606,085 | A | 8/1986 | Davies |
| 4,610,165 | A | 9/1986 | Duffy et al. |
| 4,611,768 | A | 9/1986 | Voss et al. |
| 4,624,017 | A | 11/1986 | Foletta |
| 4,637,254 | A | 1/1987 | Dyben et al. |
| 4,642,821 | A | 2/1987 | Zanuso et al. |
| 4,642,909 | A | 2/1987 | Garcia |
| 4,644,256 | A | 2/1987 | Farias et al. |
| 4,651,777 | A | 3/1987 | Hardman |
| 4,653,201 | A | 3/1987 | Seaman |
| 4,670,010 | A | 6/1987 | Dragone |
| 4,671,121 | A | 6/1987 | Schieler |
| 4,681,141 | A | 7/1987 | Wang |
| 4,682,628 | A | 7/1987 | Hill |
| 4,685,222 | A | 8/1987 | Houck |
| 4,688,277 | A | 8/1987 | Kakinoki et al. |
| 4,688,585 | A | 8/1987 | Vetter |
| 4,700,049 | A | 10/1987 | Rubin |
| 4,702,107 | A | 10/1987 | Guerrini et al. |
| 4,707,867 | A | 11/1987 | Kawabe et al. |
| 4,707,933 | A | 11/1987 | Keck et al. |
| 4,709,728 | A | 12/1987 | Ying-Chung |
| 4,716,605 | A | 1/1988 | Shepherd et al. |
| 4,722,372 | A | 2/1988 | Hoffman et al. |
| 4,735,002 | A | 4/1988 | Rath |
| 4,735,357 | A | 4/1988 | Gregory et al. |
| 4,741,363 | A | 5/1988 | Hu |

(56) References Cited

U.S. PATENT DOCUMENTS

| | | | |
|---|---|---|---|
| 4,742,583 | A | 5/1988 | Yoshida et al. |
| 4,742,836 | A | 5/1988 | Buehler |
| 4,744,515 | A | 5/1988 | Watanabe |
| 4,746,090 | A | 5/1988 | Hamilton |
| 4,762,273 | A | 8/1988 | Gregory et al. |
| 4,765,003 | A | 8/1988 | Chang |
| 4,767,922 | A | 8/1988 | Stauffer |
| 4,769,863 | A | 9/1988 | Tegg et al. |
| 4,780,595 | A | 10/1988 | Alban |
| 4,785,162 | A | 11/1988 | Kuo |
| 4,823,414 | A | 4/1989 | Piersimoni et al. |
| 4,826,129 | A | 5/1989 | Fong et al. |
| 4,839,039 | A | 6/1989 | Parsons et al. |
| 4,848,599 | A | 7/1989 | Kano et al. |
| 4,852,802 | A | 8/1989 | Iggulden et al. |
| 4,856,122 | A | 8/1989 | Pilolla |
| 4,857,112 | A | 8/1989 | Franninge |
| 4,857,705 | A | 8/1989 | Blevins |
| 4,872,485 | A | 10/1989 | Laverty, Jr. |
| 4,876,435 | A | 10/1989 | Hawkins |
| 4,882,467 | A | 11/1989 | Dimick |
| 4,883,749 | A | 11/1989 | Roberts et al. |
| 4,889,315 | A | 12/1989 | Imanaga |
| 4,894,874 | A | 1/1990 | Wilson |
| 4,909,580 | A | 3/1990 | Mitchell |
| 4,914,758 | A | 4/1990 | Shaw |
| 4,914,833 | A | 4/1990 | Pilolla et al. |
| 4,915,347 | A | 4/1990 | Iqbal et al. |
| 4,916,382 | A | 4/1990 | Kent |
| 4,916,613 | A | 4/1990 | Lange et al. |
| 4,921,129 | A | 5/1990 | Jones et al. |
| 4,921,131 | A | 5/1990 | Binderbauer et al. |
| 4,921,211 | A | 5/1990 | Novak et al. |
| 4,940,298 | A | 7/1990 | Jackson et al. |
| 4,941,219 | A | 7/1990 | Van Marcke |
| 4,942,631 | A | 7/1990 | Rosa |
| 4,948,090 | A | 8/1990 | Chen |
| 4,953,236 | A | 9/1990 | Lee et al. |
| 4,954,179 | A | 9/1990 | Franninge |
| 4,955,535 | A | 9/1990 | Tsutsui et al. |
| 4,959,603 | A | 9/1990 | Yamamoto et al. |
| 4,963,780 | A | 10/1990 | Hochstrasser |
| 4,967,425 | A | 11/1990 | Kawamura et al. |
| 4,971,106 | A | 11/1990 | Tsutsui et al. |
| 4,980,474 | A | 12/1990 | Hayasjo et al. |
| 4,980,574 | A | 12/1990 | Cirrito |
| 4,984,314 | A | 1/1991 | Weigert |
| 4,986,221 | A | 1/1991 | Shaw |
| 4,989,755 | A | 2/1991 | Shiau |
| 4,995,585 | A | 2/1991 | Gruber et al. |
| 4,998,673 | A | 3/1991 | Pilolla |
| 5,000,044 | A | 3/1991 | Duffy et al. |
| 5,008,963 | A | 4/1991 | Stein |
| 5,018,550 | A | 5/1991 | Burdorff |
| 5,018,885 | A | 5/1991 | Uggetti |
| 5,025,516 | A | 6/1991 | Wilson |
| 5,031,258 | A | 7/1991 | Shaw |
| 5,031,337 | A | 7/1991 | Pilolla et al. |
| 5,033,508 | A | 7/1991 | Laverty, Jr. |
| 5,033,715 | A | 7/1991 | Chiang et al. |
| 5,060,323 | A | 10/1991 | Shaw |
| 5,062,164 | A | 11/1991 | Lee et al. |
| 5,063,622 | A | 11/1991 | Tsutsui et al. |
| 5,063,955 | A | 11/1991 | Sakakibara |
| 5,072,618 | A | 12/1991 | Taylor et al. |
| 5,074,322 | A | 12/1991 | Jaw |
| 5,074,520 | A | 12/1991 | Lee et al. |
| 5,076,424 | A | 12/1991 | Nakamura |
| 5,080,324 | A | 1/1992 | Chi |
| RE33,810 | E | 2/1992 | Strieter |
| 5,084,984 | A | 2/1992 | Duchoud et al. |
| 5,086,526 | A | 2/1992 | Van Marcke |
| 5,092,560 | A | 3/1992 | Chen |
| 5,095,941 | A | 3/1992 | Betz |
| 5,099,587 | A | 3/1992 | Jarosch |
| 5,111,594 | A | 5/1992 | Allen |
| D326,711 | S | 6/1992 | Lotito et al. |
| 5,117,693 | A | 6/1992 | Duksa |
| 5,133,095 | A | 7/1992 | Shiba et al. |
| 5,144,757 | A | 9/1992 | Sasso |
| 5,146,695 | A | 9/1992 | Yang |
| 5,158,114 | A | 10/1992 | Botsolas |
| 5,163,234 | A | 11/1992 | Tsukamoto et al. |
| 5,169,118 | A | 12/1992 | Whiteside |
| 5,170,944 | A | 12/1992 | Shirai |
| D332,194 | S | 1/1993 | Hines |
| D332,195 | S | 1/1993 | Hines |
| D332,365 | S | 1/1993 | Hines |
| D332,366 | S | 1/1993 | Hines |
| D332,369 | S | 1/1993 | Hanna et al. |
| D332,370 | S | 1/1993 | Hanna et al. |
| D332,542 | S | 1/1993 | Hines |
| D332,679 | S | 1/1993 | Hines |
| D332,849 | S | 1/1993 | Hines |
| 5,175,892 | A | 1/1993 | Shaw |
| 5,177,879 | A | 1/1993 | Muta |
| 5,181,328 | A | 1/1993 | Bouverie |
| D332,889 | S | 2/1993 | Hines |
| 5,184,642 | A | 2/1993 | Powell |
| 5,186,360 | A | 2/1993 | Mease et al. |
| D334,266 | S | 3/1993 | Hines |
| 5,193,563 | A | 3/1993 | Melech |
| 5,199,116 | A | 4/1993 | Fischer |
| 5,199,118 | A | 4/1993 | Cole et al. |
| 5,199,188 | A | 4/1993 | Franz |
| 5,202,666 | A | 4/1993 | Knippscheer |
| D336,572 | S | 6/1993 | Gunderson et al. |
| 5,216,251 | A | 6/1993 | Matschke |
| 5,217,035 | A | 6/1993 | Van Marcke |
| 5,224,685 | A | 7/1993 | Chiang et al. |
| 5,226,629 | A | 7/1993 | Millman et al. |
| 5,230,109 | A | 7/1993 | Zaccai et al. |
| D338,361 | S | 8/1993 | Hines |
| 5,239,610 | A | 8/1993 | Shao |
| 5,243,717 | A | 9/1993 | Yasuo |
| D340,374 | S | 10/1993 | Hines |
| D340,375 | S | 10/1993 | Hines |
| 5,251,872 | A | 10/1993 | Kodaira |
| 5,253,376 | A | 10/1993 | Fait |
| 5,255,822 | A | 10/1993 | Mease et al. |
| D341,724 | S | 11/1993 | Hines |
| 5,257,423 | A | 11/1993 | Jacobsen et al. |
| 5,259,410 | A | 11/1993 | Trueb et al. |
| 5,265,288 | A | 11/1993 | Allison |
| 5,265,628 | A | 11/1993 | Sage et al. |
| D342,175 | S | 12/1993 | Hines |
| D342,177 | S | 12/1993 | Hanna et al. |
| 5,267,475 | A | 12/1993 | Gaston |
| 5,269,071 | A | 12/1993 | Hamabe et al. |
| 5,272,918 | A | 12/1993 | Gaston et al. |
| D342,992 | S | 1/1994 | Robertson |
| 5,280,679 | A | 1/1994 | Edelman |
| 5,282,812 | A | 2/1994 | Suarez, Jr. |
| D344,830 | S | 3/1994 | Carter et al. |
| 5,341,839 | A | 8/1994 | Kobayashi et al. |
| 5,347,864 | A | 9/1994 | Senghaas et al. |
| 5,351,347 | A | 10/1994 | Kunkel |
| 5,351,417 | A | 10/1994 | Rubin |
| 5,362,026 | A | 11/1994 | Kobayashi et al. |
| 5,363,517 | A | 11/1994 | Botsolas |
| 5,367,442 | A | 11/1994 | Frost et al. |
| 5,369,818 | A | 12/1994 | Barnum et al. |
| 5,377,424 | A | 1/1995 | Albanes |
| 5,377,427 | A | 1/1995 | Mashata |
| D355,949 | S | 2/1995 | Laughton |
| 5,397,099 | A | 3/1995 | Pilolla |
| 5,404,419 | A | 4/1995 | Artis, Jr. |
| 5,412,816 | A | 5/1995 | Paterson et al. |
| 5,412,818 | A | 5/1995 | Chen |
| 5,426,271 | A | 6/1995 | Clark et al. |
| D361,372 | S | 8/1995 | Enthoven |
| 5,438,714 | A | 8/1995 | Shaw |
| 5,438,763 | A | 8/1995 | Yang |
| 5,442,867 | A | 8/1995 | Robinson |

(56) References Cited

U.S. PATENT DOCUMENTS

| | | | |
|---|---|---|---|
| D362,901 | S | 10/1995 | Dannenberg et al. |
| 5,459,944 | A | 10/1995 | Tatsutani et al. |
| D364,675 | S | 11/1995 | Tebbe |
| 5,477,984 | A | 12/1995 | Sayama et al. |
| 5,482,250 | A | 1/1996 | Kodaira |
| 5,497,135 | A | 3/1996 | Wisskirchen et al. |
| 5,504,950 | A | 4/1996 | Natalizia et al. |
| 5,514,346 | A | 5/1996 | Fujita |
| 5,522,411 | A | 6/1996 | Johnson |
| 5,548,119 | A | 8/1996 | Nortier |
| 5,555,912 | A | 9/1996 | Saadi et al. |
| 5,561,871 | A | 10/1996 | Laughton |
| 5,566,404 | A | 10/1996 | Laughton |
| 5,570,869 | A | 11/1996 | Diaz et al. |
| 5,586,746 | A | 12/1996 | Humpert et al. |
| 5,588,636 | A | 12/1996 | Eichholz et al. |
| 5,595,216 | A | 1/1997 | Pilolla |
| 5,610,591 | A | 3/1997 | Gallagher |
| 5,611,093 | A | 3/1997 | Barnum et al. |
| 5,611,517 | A | 3/1997 | Saadi et al. |
| 5,625,908 | A | 5/1997 | Shaw |
| 5,627,375 | A | 5/1997 | Hsieh |
| 5,640,781 | A | 6/1997 | Carson |
| 5,642,462 | A | 6/1997 | Huff |
| D380,529 | S | 7/1997 | Laughton |
| 5,651,189 | A | 7/1997 | Coykendall et al. |
| 5,651,384 | A | 7/1997 | Rudrich |
| 5,670,945 | A | 9/1997 | Applonie |
| D387,144 | S | 12/1997 | Flaherty |
| 5,694,653 | A | 12/1997 | Harald |
| 5,699,833 | A | 12/1997 | Tsataros |
| 5,701,929 | A | 12/1997 | Helmsderfer |
| 5,727,579 | A | 3/1998 | Chardack |
| 5,730,165 | A | 3/1998 | Philipp |
| D393,700 | S | 4/1998 | Trueb et al. |
| 5,743,511 | A | 4/1998 | Eichholz et al. |
| D394,495 | S | 5/1998 | Hauser, II |
| 5,758,688 | A | 6/1998 | Hamanaka et al. |
| 5,765,242 | A | 6/1998 | Marciano |
| 5,769,120 | A | 6/1998 | Laverty, Jr. et al. |
| 5,781,942 | A | 7/1998 | Allen et al. |
| 5,782,382 | A | 7/1998 | Van Marcke |
| D398,969 | S | 9/1998 | Barnum et al. |
| 5,813,047 | A | 9/1998 | Teichroeb |
| 5,819,335 | A | 10/1998 | Hennessy |
| 5,819,336 | A | 10/1998 | Gilliam et al. |
| 5,829,072 | A | 11/1998 | Hirsch et al. |
| D402,358 | S | 12/1998 | Bonnell |
| 5,855,356 | A | 1/1999 | Fait |
| 5,868,311 | A | 2/1999 | Cretu-Petra |
| 5,873,178 | A | 2/1999 | Johnson |
| 5,873,179 | A | 2/1999 | Gregory et al. |
| 5,875,562 | A | 3/1999 | Fogarty |
| 5,893,387 | A | 4/1999 | Paterson et al. |
| 5,915,417 | A | 6/1999 | Diaz et al. |
| 5,915,851 | A | 6/1999 | Wattrick et al. |
| D411,876 | S | 7/1999 | Hafner et al. |
| 5,918,855 | A | 7/1999 | Hamanaka et al. |
| 5,924,148 | A | 7/1999 | Flowers, Sr. |
| 5,943,712 | A | 8/1999 | Van Marcke |
| 5,943,713 | A | 8/1999 | Paterson et al. |
| 5,945,068 | A | 8/1999 | Ferone |
| 5,945,913 | A | 8/1999 | Gallagher |
| 5,950,983 | A | 9/1999 | Jahrling |
| 5,954,069 | A | 9/1999 | Foster |
| 5,961,095 | A | 10/1999 | Schrott |
| 5,966,753 | A | 10/1999 | Gauthier et al. |
| 5,972,126 | A | 10/1999 | Fernie |
| 5,974,685 | A | 11/1999 | Hironaka |
| 5,979,500 | A | 11/1999 | Jahrling et al. |
| 5,984,262 | A | 11/1999 | Parsons et al. |
| 5,988,588 | A | 11/1999 | Allen et al. |
| 5,992,430 | A | 11/1999 | Chardack et al. |
| 6,000,429 | A | 12/1999 | Van Marcke |
| 6,003,170 | A | 12/1999 | Humpert et al. |
| 6,006,388 | A | 12/1999 | Young |
| 6,006,784 | A | 12/1999 | Tsutsui et al. |
| D420,727 | S | 2/2000 | Hundley |
| 6,018,885 | A | 2/2000 | Hill |
| 6,029,292 | A | 2/2000 | Leiferman et al. |
| 6,029,293 | A | 2/2000 | Paterson et al. |
| 6,038,786 | A | 3/2000 | Aisenberg et al. |
| D422,346 | S | 4/2000 | Svendsen |
| 6,056,261 | A | 5/2000 | Aparicio et al. |
| 6,059,192 | A | 5/2000 | Zosimadis |
| 6,067,673 | A | 5/2000 | Paese et al. |
| D428,477 | S | 7/2000 | O'Connell et al. |
| 6,082,407 | A | 7/2000 | Paterson et al. |
| 6,089,086 | A | 7/2000 | Swindler et al. |
| 6,110,292 | A | 8/2000 | Jewett et al. |
| D431,288 | S | 9/2000 | Helmsderfer |
| 6,119,285 | A | 9/2000 | Kim |
| D433,109 | S | 10/2000 | Wilke et al. |
| 6,125,482 | A | 10/2000 | Foster |
| 6,127,671 | A | 10/2000 | Parsons et al. |
| 6,128,826 | A | 10/2000 | Robinson |
| 6,131,587 | A | 10/2000 | Chardack et al. |
| 6,142,342 | A | 11/2000 | Lewis |
| 6,161,227 | A | 12/2000 | Bargenquast |
| 6,161,814 | A | 12/2000 | Jahrling |
| D435,893 | S | 1/2001 | Helmsderfer |
| 6,178,572 | B1 | 1/2001 | Van Marcke |
| 6,185,838 | B1 | 2/2001 | Moore |
| 6,189,163 | B1 | 2/2001 | Van Marcke |
| 6,189,230 | B1 | 2/2001 | Huen |
| 6,192,530 | B1 | 2/2001 | Dai |
| 6,199,428 | B1 | 3/2001 | Estevez-Garcia et al. |
| 6,202,980 | B1 | 3/2001 | Vincent et al. |
| 6,206,340 | B1 | 3/2001 | Paese et al. |
| 6,209,392 | B1 | 4/2001 | Rapala |
| 6,212,707 | B1 | 4/2001 | Thompson et al. |
| 6,216,534 | B1 | 4/2001 | Ross, Jr. et al. |
| 6,219,857 | B1 | 4/2001 | Wu |
| 6,219,859 | B1 | 4/2001 | Derakhshan |
| 6,236,317 | B1 | 5/2001 | Cohen et al. |
| 6,250,601 | B1 | 6/2001 | Kolar et al. |
| 6,253,609 | B1 | 7/2001 | Ross, Jr. et al. |
| 6,253,611 | B1 | 7/2001 | Varga et al. |
| 6,257,264 | B1 | 7/2001 | Sturman et al. |
| 6,267,007 | B1 | 7/2001 | Gunther |
| D446,664 | S | 8/2001 | Petri |
| D447,224 | S | 8/2001 | Barnum et al. |
| 6,269,695 | B1 | 8/2001 | Cesternino et al. |
| 6,273,394 | B1 | 8/2001 | Vincent et al. |
| 6,279,179 | B1 | 8/2001 | Register |
| 6,279,587 | B1 | 8/2001 | Yamamoto |
| 6,282,812 | B1 | 9/2001 | Wee et al. |
| 6,286,153 | B1 | 9/2001 | Keller |
| 6,289,728 | B1 | 9/2001 | Wilkins |
| 6,294,786 | B1 | 9/2001 | Marcichow et al. |
| 6,295,410 | B1 | 9/2001 | Helms et al. |
| D448,585 | S | 10/2001 | Petri |
| 6,298,502 | B1 | 10/2001 | Brown |
| 6,317,717 | B1 | 11/2001 | Lindsey et al. |
| 6,321,785 | B1 | 11/2001 | Bergmann |
| 6,322,005 | B1 | 11/2001 | Kern et al. |
| 6,340,032 | B1 | 1/2002 | Zosimadis |
| 6,341,389 | B2 | 1/2002 | Philipps-Liebich et al. |
| D453,882 | S | 2/2002 | Petri |
| 6,349,484 | B1 | 2/2002 | Cohen |
| 6,351,866 | B1 | 3/2002 | Bragulla |
| 6,363,549 | B2 | 4/2002 | Humpert et al. |
| 6,370,951 | B1 | 4/2002 | Kerchaert et al. |
| 6,386,390 | B1 | 5/2002 | Tinker |
| 6,390,125 | B2 | 5/2002 | Pawelzik et al. |
| 6,393,634 | B1 | 5/2002 | Kodaira et al. |
| 6,401,274 | B1 | 6/2002 | Brown |
| 6,408,881 | B2 | 6/2002 | Lorenzelli et al. |
| 6,418,788 | B2 | 7/2002 | Articolo |
| 6,426,701 | B1 | 7/2002 | Levy et al. |
| 6,431,189 | B1 | 8/2002 | Deibert |
| D462,195 | S | 9/2002 | Wang |
| RE37,888 | E | 10/2002 | Cretu-Petra |
| 6,467,514 | B1 | 10/2002 | Korst et al. |

(56) References Cited

U.S. PATENT DOCUMENTS 6,467,651 B1 10/2002 Muderlak et al.
6,481,040 B1 11/2002 McIntyre
6,481,634 B1 11/2002 Zosimadis
6,484,965 B1 11/2002 Reaves
6,508,121 B2 1/2003 Eck
6,523,193 B2 2/2003 Saraya
6,523,404 B1 2/2003 Murphy et al.
6,568,655 B2 5/2003 Paese et al.
6,572,207 B2 6/2003 Hase et al.
D477,060 S 7/2003 Loberger et al.
6,598,245 B2 7/2003 Nishioka
6,619,320 B2 9/2003 Parsons
6,624,606 B2 9/2003 Kushida et al.
6,639,209 B1 10/2003 Patterson et al.
D481,826 S 11/2003 Martinuzzo et al.
6,641,002 B2 11/2003 Gerenraich et al.
6,643,865 B2 11/2003 Bork et al.
6,651,851 B2 11/2003 Muderlak et al.
D483,152 S 12/2003 Martinuzzo et al.
6,658,934 B1 12/2003 Housey et al.
D484,958 S 1/2004 Loberger et al.
6,671,890 B2 1/2004 Nishioka
6,671,898 B1 1/2004 Eggenberger et al.
6,679,285 B2 1/2004 Pablo
6,691,340 B2 2/2004 Honda et al.
6,691,724 B2 2/2004 Ford
6,711,949 B1 3/2004 Sorenson
6,711,950 B1 3/2004 Yamaura et al.
6,715,730 B2 4/2004 Ehr
6,766,589 B1 7/2004 Bory et al.
6,769,197 B1 8/2004 Tai
6,769,443 B2 8/2004 Bush
6,770,869 B2 8/2004 Patterson et al.
D496,450 S 9/2004 Loberger et al.
6,789,197 B1 9/2004 Saito
6,812,657 B2 11/2004 Raimondi
6,827,294 B1 12/2004 Fan et al.
6,843,079 B2 1/2005 Hird
6,857,314 B2 2/2005 Ohhashi et al.
6,871,541 B2 3/2005 Weisse
6,882,278 B2 4/2005 Winings et al.
6,883,563 B2 4/2005 Smith
D507,634 S 7/2005 Loberger et al.
6,912,864 B2 7/2005 Roche et al.
6,915,690 B2 7/2005 Okada et al.
6,922,144 B2 7/2005 Bulin et al.
D508,117 S 8/2005 Loberger et al.
6,922,912 B2 8/2005 Phillips
6,928,235 B2 8/2005 Pollack
6,929,150 B2 8/2005 Muderlak et al.
D509,577 S 9/2005 Loberger et al.
6,950,606 B2 9/2005 Logan et al.
D511,205 S 11/2005 Loberger et al.
D511,821 S 11/2005 Loberger et al.
6,962,005 B1 11/2005 Khosropour et al.
6,962,168 B2 11/2005 McDaniel et al.
6,964,405 B2 11/2005 Marcichow et al.
6,966,334 B2 11/2005 Bolster
6,968,860 B1 11/2005 Haenlein et al.
D512,648 S 12/2005 Smith et al.
6,980,126 B2 12/2005 Fournier
6,986,171 B1 1/2006 Perrin
6,993,968 B2 2/2006 Kogure
6,996,863 B2 2/2006 Kaneko
7,007,318 B1 3/2006 Bork et al.
7,014,166 B1 3/2006 Wang
7,018,473 B2 3/2006 Shadrach, III
7,025,227 B2 4/2006 Oliver et al.
7,039,301 B1 5/2006 Aisenberg et al.
7,039,963 B2 5/2006 Loberger et al.
7,079,037 B2 7/2006 Ross, Jr. et al.
D526,394 S 8/2006 Loberger et al.
D527,085 S 8/2006 Loberger et al.
7,082,828 B1 8/2006 Wilkins
7,093,485 B2 8/2006 Newman et al.
D527,809 S 9/2006 Loberger et al.
7,104,519 B2 9/2006 O'Maley et al.
7,107,631 B2 9/2006 Lang et al.
7,114,510 B2 10/2006 Peters et al.
7,150,293 B2 12/2006 Jonte
7,165,450 B2 1/2007 Jamnia et al.
7,174,577 B2 2/2007 Jost et al.
D537,927 S 3/2007 Loberger et al.
D538,898 S 3/2007 Trepanier
D539,400 S 3/2007 Loberger et al.
7,191,484 B2 3/2007 Dawe
7,191,920 B2 3/2007 Boll et al.
7,198,175 B2 4/2007 Ophardt
7,201,052 B2 4/2007 Lee
D542,474 S 5/2007 Churchill et al.
7,219,686 B2 5/2007 Schmitz et al.
7,228,874 B2 6/2007 Bolderheij et al.
7,228,984 B2 6/2007 Tack et al.
7,232,111 B2 6/2007 McDaniel et al.
7,242,307 B1 7/2007 LeBlond et al.
7,271,728 B2 9/2007 Taylor et al.
7,278,624 B2 10/2007 Iott et al.
7,296,765 B2 11/2007 Rodrian
7,305,722 B2 12/2007 Sha et al.
7,315,165 B2 1/2008 Kleinen et al.
7,318,949 B2 1/2008 Shadrach, III
7,320,146 B2 1/2008 Nortier et al.
D561,315 S 2/2008 Loberger et al.
7,343,799 B2 3/2008 Nagakura et al.
7,350,245 B2 4/2008 Giagni
7,350,413 B2 4/2008 Nagakura et al.
7,364,053 B2 4/2008 Ophardt
7,377,163 B2 5/2008 Miyagawa
7,396,000 B2 7/2008 Parsons et al.
7,406,722 B2 8/2008 Fukuizumi et al.
7,409,860 B2 8/2008 Ferreira et al.
7,437,833 B2 10/2008 Sato et al.
7,443,305 B2 10/2008 Verdiramo
7,451,894 B2 11/2008 Ophardt
7,455,197 B2 11/2008 Ophardt
7,458,261 B2 12/2008 Miyagawa
7,464,418 B2 12/2008 Seggio et al.
7,467,550 B2 12/2008 Betz, et al.
7,471,883 B2 12/2008 Seutter et al.
7,472,433 B2 1/2009 Rodenbeck et al.
7,477,148 B2 1/2009 Lynn et al.
7,484,409 B2 2/2009 Dykstra et al.
D588,676 S 3/2009 Loberger et al.
7,516,939 B2 4/2009 Bailey
D591,838 S 5/2009 Coleman
7,527,174 B2 5/2009 Meehan et al.
7,530,269 B2 5/2009 Newman et al.
7,533,787 B2 5/2009 Muderlak et al.
7,537,195 B2 5/2009 McDaniel et al.
7,555,209 B2 6/2009 Pradas Diez et al.
7,588,168 B2 9/2009 Bagwell et al.
7,596,883 B2 10/2009 Kameishi
7,597,122 B1 10/2009 Smith
7,607,442 B2 10/2009 Barnhill et al.
7,607,443 B2 10/2009 Barnhill et al.
7,614,096 B2 11/2009 Vincent
7,614,160 B2 11/2009 Kameishi et al.
7,617,830 B2 11/2009 Barnhill et al.
7,627,909 B2 12/2009 Esche
7,631,372 B2 12/2009 Marty et al.
7,641,173 B2 1/2010 Goodman
7,641,740 B2 1/2010 Barnhill et al.
7,650,653 B2 1/2010 Johnson et al.
7,651,068 B2 1/2010 Bailey
D610,242 S 2/2010 Loberger et al.
7,657,162 B2 2/2010 Itoigawa et al.
7,659,824 B2 2/2010 Prodanovich et al.
7,681,447 B2 3/2010 Nagakura et al.
7,682,464 B2 3/2010 Glenn et al.
D614,273 S 4/2010 Loberger et al.
7,690,395 B2 4/2010 Jonte et al.
7,690,623 B2 4/2010 Parsons et al.
7,698,770 B2 4/2010 Barnhill et al.
7,701,164 B2 4/2010 Clothier et al.

(56) References Cited

U.S. PATENT DOCUMENTS

| | | | |
|---|---|---|---|
| 7,721,602 | B2 | 5/2010 | Benner et al. |
| 7,726,334 | B2 | 6/2010 | Ross, Jr. et al. |
| 7,731,154 | B2 | 6/2010 | Parsons et al. |
| 7,743,438 | B2 | 6/2010 | Chen |
| 7,743,782 | B2 | 6/2010 | Jost |
| 7,750,594 | B2 | 7/2010 | Clothier et al. |
| 7,754,021 | B2 | 7/2010 | Barnhill et al. |
| 7,754,022 | B2 | 7/2010 | Barnhill et al. |
| 7,757,700 | B2 | 7/2010 | Barnhill et al. |
| 7,758,701 | B2 | 7/2010 | Barnhill et al. |
| 7,766,026 | B2 | 8/2010 | Boey |
| 7,766,194 | B2 | 8/2010 | Boll et al. |
| 7,774,953 | B1 | 8/2010 | Duran |
| 7,784,481 | B2 | 8/2010 | Kunkel |
| 7,786,628 | B2 | 8/2010 | Childe et al. |
| 7,789,095 | B2 | 9/2010 | Barnhill et al. |
| 7,797,769 | B2 | 9/2010 | Ozenick |
| 7,804,409 | B2 | 9/2010 | Munro et al. |
| D625,792 | S | 10/2010 | Rundberg et al. |
| 7,812,598 | B2 | 10/2010 | Yasuda et al. |
| 7,814,582 | B2 | 10/2010 | Reddy et al. |
| 7,815,134 | B2 | 10/2010 | Hohl |
| 7,818,083 | B2 | 10/2010 | Glenn et al. |
| 7,819,136 | B1 | 10/2010 | Eddy |
| D628,280 | S | 11/2010 | Loberger et al. |
| 7,825,564 | B2 | 11/2010 | Croft et al. |
| RE42,005 | E | 12/2010 | Jost et al. |
| D629,877 | S | 12/2010 | Rundberg et al. |
| 7,856,736 | B2 | 12/2010 | Churchill et al. |
| 7,860,671 | B1 | 12/2010 | LaCaze |
| D633,992 | S | 3/2011 | Rundberg et al. |
| D637,350 | S | 5/2011 | Kato et al. |
| 7,944,116 | B2 | 5/2011 | Causier |
| 7,946,055 | B2 | 5/2011 | Churchill et al. |
| 7,971,368 | B2 | 7/2011 | Fukaya et al. |
| 8,037,619 | B2 | 10/2011 | Liu |
| 8,064,756 | B2 | 11/2011 | Liu |
| 8,128,465 | B2 | 3/2012 | Collins |
| 8,155,508 | B2 | 4/2012 | Caine et al. |
| 8,201,344 | B2 | 6/2012 | Sawabe et al. |
| 2001/0011389 | A1 | 8/2001 | Philipps-Liebich et al. |
| 2001/0011390 | A1 | 8/2001 | Humpert et al. |
| 2001/0020619 | A1 | 9/2001 | Pfeifer et al. |
| 2002/0006275 | A1 | 1/2002 | Pollack |
| 2002/0019709 | A1 | 2/2002 | Segal |
| 2002/0104159 | A1 | 8/2002 | Nishioka |
| 2002/0157176 | A1 | 10/2002 | Wawrla et al. |
| 2002/0171056 | A1 | 11/2002 | Paese et al. |
| 2003/0037612 | A1 | 2/2003 | Nagakura et al. |
| 2003/0172547 | A1 | 9/2003 | Shephard, II |
| 2003/0188380 | A1 | 10/2003 | Loberger et al. |
| 2003/0210140 | A1 | 11/2003 | Menard et al. |
| 2003/0213062 | A1 | 11/2003 | Honda et al. |
| 2004/0016296 | A1 | 1/2004 | Weisse |
| 2004/0025248 | A1 | 2/2004 | Lang et al. |
| 2004/0083547 | A1 | 5/2004 | Mercier |
| 2004/0128755 | A1 | 7/2004 | Loberger et al. |
| 2004/0129075 | A1 | 7/2004 | Sorenson |
| 2004/0143898 | A1 | 7/2004 | Jost et al. |
| 2004/0149779 | A1 | 8/2004 | Boll et al. |
| 2004/0182151 | A1 | 9/2004 | Meure |
| 2004/0221645 | A1 | 11/2004 | Brzozowski et al. |
| 2004/0221646 | A1 | 11/2004 | Ohhashi et al. |
| 2004/0221647 | A1 | 11/2004 | Sabatino |
| 2004/0238660 | A1 | 12/2004 | Fan et al. |
| 2005/0000015 | A1 | 1/2005 | Kaneko |
| 2005/0087557 | A1 | 4/2005 | Oliver et al. |
| 2005/0098968 | A1 | 5/2005 | Dyson et al. |
| 2005/0199843 | A1 | 9/2005 | Jost et al. |
| 2005/0205818 | A1 | 9/2005 | Bayley et al. |
| 2006/0098961 | A1 | 5/2006 | Seutter et al. |
| 2006/0101575 | A1 | 5/2006 | Louis |
| 2006/0102642 | A1 | 5/2006 | Muntzing et al. |
| 2006/0145111 | A1 | 7/2006 | Lang et al. |
| 2006/0150316 | A1 | 7/2006 | Fukuizumi et al. |
| 2006/0151513 | A1 | 7/2006 | Shadrach, III |
| 2006/0185074 | A1 | 8/2006 | Loberger et al. |
| 2006/0200903 | A1 | 9/2006 | Rodenbeck et al. |
| 2006/0207019 | A1 | 9/2006 | Vincent |
| 2006/0225200 | A1 | 10/2006 | Wierenga |
| 2007/0023565 | A1 | 2/2007 | Babikian |
| 2007/0079524 | A1 | 4/2007 | Sato et al. |
| 2007/0094787 | A1 | 5/2007 | Hwang |
| 2007/0144034 | A1 | 6/2007 | Kameishi |
| 2007/0151338 | A1 | 7/2007 | Benner et al. |
| 2007/0194637 | A1 | 8/2007 | Childe et al. |
| 2007/0230839 | A1 | 10/2007 | Childe et al. |
| 2007/0252551 | A1 | 11/2007 | Clothier et al. |
| 2007/0261162 | A1 | 11/2007 | Atkinson |
| 2007/0263994 | A1 | 11/2007 | Diez et al. |
| 2007/0278983 | A1 | 12/2007 | Clothier et al. |
| 2008/0005833 | A1 | 1/2008 | Bayley et al. |
| 2008/0018995 | A1 | 1/2008 | Baun |
| 2008/0072668 | A1 | 3/2008 | Miyagawa |
| 2008/0078019 | A1 | 4/2008 | Allen, Jr. et al. |
| 2008/0083786 | A1 | 4/2008 | Marin |
| 2008/0098950 | A1 | 5/2008 | Gudjohnsen et al. |
| 2008/0099088 | A1 | 5/2008 | Boey |
| 2008/0109956 | A1 | 5/2008 | Bayley et al. |
| 2008/0127410 | A1 | 6/2008 | Schmitt et al. |
| 2008/0185396 | A1 | 8/2008 | Yang et al. |
| 2008/0185398 | A1 | 8/2008 | Yang et al. |
| 2008/0185399 | A1 | 8/2008 | Yang et al. |
| 2008/0189850 | A1 | 8/2008 | Seggio et al. |
| 2008/0193111 | A1 | 8/2008 | Seutter et al. |
| 2008/0209760 | A1 | 9/2008 | French et al. |
| 2008/0213644 | A1 | 9/2008 | Shindoh et al. |
| 2008/0216343 | A1 | 9/2008 | Churchill et al. |
| 2008/0216344 | A1 | 9/2008 | Churchill et al. |
| 2008/0222910 | A1 | 9/2008 | Churchill et al. |
| 2008/0253754 | A1 | 10/2008 | Rubin |
| 2008/0256825 | A1 | 10/2008 | Hsu |
| 2008/0271527 | A1 | 11/2008 | Hewitt |
| 2008/0285134 | A1 | 11/2008 | Closset et al. |
| 2008/0289098 | A1 | 11/2008 | Kunkel |
| 2008/0301970 | A1 | 12/2008 | Hackwell et al. |
| 2008/0313918 | A1 | 12/2008 | Dyson et al. |
| 2008/0313919 | A1 | 12/2008 | Churchill et al. |
| 2008/0317448 | A1 | 12/2008 | Brown et al. |
| 2009/0000023 | A1 | 1/2009 | Wegelinn et al. |
| 2009/0000024 | A1 | 1/2009 | Louis et al. |
| 2009/0000142 | A1 | 1/2009 | Churchill et al. |
| 2009/0000147 | A1 | 1/2009 | Collins |
| 2009/0031493 | A1 | 2/2009 | Tsujita et al. |
| 2009/0034946 | A1 | 2/2009 | Caine et al. |
| 2009/0049599 | A1 | 2/2009 | Parsons et al. |
| 2009/0056011 | A1 | 3/2009 | Wolf et al. |
| 2009/0058666 | A1 | 3/2009 | Clabaugh |
| 2009/0069870 | A1 | 3/2009 | Haase et al. |
| 2009/0077736 | A1 | 3/2009 | Loberger et al. |
| 2009/0094740 | A1 | 4/2009 | Ji |
| 2009/0100593 | A1 | 4/2009 | Lincoln et al. |
| 2009/0113746 | A1 | 5/2009 | Churchill et al. |
| 2009/0113748 | A1 | 5/2009 | Dyson et al. |
| 2009/0119832 | A1 | 5/2009 | Conroy |
| 2009/0119942 | A1 | 5/2009 | Aisenberg et al. |
| 2009/0126103 | A1 | 5/2009 | Dietrich et al. |
| 2009/0159612 | A1 | 6/2009 | Beavis et al. |
| 2009/0236358 | A1 | 9/2009 | Rippl et al. |
| 2009/0243243 | A1 | 10/2009 | Watson |
| 2009/0266157 | A1 | 10/2009 | Maruo et al. |
| 2009/0293190 | A1 | 12/2009 | Ringelstetter et al. |
| 2009/0293192 | A1 | 12/2009 | Pons |
| 2010/0014844 | A1 | 1/2010 | Dannenberg et al. |
| 2010/0132112 | A1 | 6/2010 | Bayley et al. |
| 2010/0139394 | A1 | 6/2010 | Pauer et al. |
| 2010/0154239 | A1 | 6/2010 | Hutchinson |
| 2010/0168926 | A1 | 7/2010 | Bayley et al. |
| 2010/0192399 | A1 | 8/2010 | Sawabe et al. |
| 2010/0199759 | A1 | 8/2010 | Prasad |
| 2010/0213208 | A1 | 8/2010 | Bem et al. |
| 2010/0219013 | A1 | 9/2010 | Liddell |
| 2010/0223993 | A1 | 9/2010 | Shimizu et al. |
| 2010/0231392 | A1 | 9/2010 | Sherron |

(56) References Cited

U.S. PATENT DOCUMENTS

| | | | | |
|---|---|---|---|---|
| 2010/0236092 | A1 | 9/2010 | Causier | |
| 2010/0252759 | A1 | 10/2010 | Guler et al. | |
| 2010/0269364 | A1 | 10/2010 | Liu | |
| 2010/0276529 | A1 | 11/2010 | Nguyen | |
| 2010/0296799 | A1 | 11/2010 | Liu | |
| 2011/0006083 | A1 | 1/2011 | Walters et al. | |
| 2011/0023319 | A1 | 2/2011 | Fukaya et al. | |
| 2011/0171083 | A1 | 7/2011 | Swistak | |
| 2011/0277342 | A1 | 11/2011 | Ishii et al. | |
| 2012/0011739 | A1 | 1/2012 | Nakamura | |
| 2012/0017459 | A1 | 1/2012 | Kikuchi et al. | |
| 2012/0017460 | A1 | 1/2012 | Kikuchi et al. | |
| 2012/0055557 | A1 | 3/2012 | Belz et al. | |
| 2013/0025045 | A1 | 1/2013 | Gagnon et al. | |
| 2013/0055588 | A1 | 3/2013 | Nakamura et al. | |
| 2013/0139400 | A1* | 6/2013 | Fukano | 34/202 |

FOREIGN PATENT DOCUMENTS

| | | | |
|---|---|---|---|
| AU | 2006274708 | | 2/2007 |
| AU | 2006274715 | | 2/2007 |
| BE | 647407 | | 1/1928 |
| DE | 504089 | | 7/1930 |
| DE | 2018695 | | 10/1971 |
| DE | 2304815 | | 8/1974 |
| DE | 2657164 | A1 | 6/1978 |
| DE | 3036623 | | 2/1982 |
| DE | 4218658 | | 12/1992 |
| DE | 9304270 | | 9/1993 |
| DE | 9304160 | | 7/1994 |
| DE | 19608157 | | 7/1997 |
| DE | 10210474 | | 9/2002 |
| DE | 69821140 | | 11/2004 |
| DE | 202004012352 | U1 | 12/2004 |
| EP | 0 274 785 | A | 7/1988 |
| EP | 1057942 | | 12/2000 |
| EP | 1241301 | | 9/2002 |
| EP | 1250876 | | 10/2002 |
| EP | 1258568 | | 11/2002 |
| EP | 1057441 | | 9/2006 |
| EP | 1912549 | | 3/2010 |
| EP | 2177142 | | 4/2010 |
| EP | 2277424 | | 1/2011 |
| EP | 2554085 | A2 | 2/2013 |
| GB | 737054 | | 9/1955 |
| GB | 909069 | | 10/1962 |
| GB | 2249026 | | 4/1992 |
| GB | 2428569 | | 2/2007 |
| GB | 2450563 | A | 12/2008 |
| JP | 49-037685 | | 7/1947 |
| JP | 1256632 | | 10/1989 |
| JP | 04-136195 | | 12/1992 |
| JP | 5163748 | A | 6/1993 |
| JP | 05-055988 | | 7/1993 |
| JP | 06-062977 | | 3/1994 |
| JP | 8-140891 | | 6/1996 |
| JP | 08164088 | | 6/1996 |
| JP | 08-196470 | | 8/1996 |
| JP | 9-056640 | | 3/1997 |
| JP | 9-135788 | | 5/1997 |
| JP | 9242155 | | 9/1997 |
| JP | 10-113304 | | 5/1998 |
| JP | 10-113305 | | 5/1998 |
| JP | 10-257992 | | 9/1998 |
| JP | 10248748 | A | 9/1998 |
| JP | 11-000283 | | 1/1999 |
| JP | 2000-157448 | | 6/2000 |
| JP | 2000000178 | | 7/2000 |
| JP | 2000-300461 | | 10/2000 |
| JP | 2000271039 | | 10/2000 |
| JP | 2000282528 | | 10/2000 |
| JP | 2001-104213 | | 4/2001 |
| JP | 2001140305 | A | 5/2001 |
| JP | 2002-136448 | | 5/2002 |
| JP | 2002-345682 | | 12/2002 |
| JP | 2003153823 | | 5/2003 |
| JP | 2004-261510 | | 9/2004 |
| JP | 2006-081925 | | 3/2006 |
| JP | 2006101987 | | 4/2006 |
| JP | 2006-192250 | | 7/2006 |
| JP | 2006-204738 | | 8/2006 |
| JP | 2006-304926 | | 11/2006 |
| JP | 2007054670 | | 3/2007 |
| JP | 2007-082904 | | 4/2007 |
| JP | 2007-098106 | | 4/2007 |
| JP | 2007082904 | A | 4/2007 |
| JP | 2008-005883 | | 1/2008 |
| JP | 2008-110240 | | 5/2008 |
| JP | 200899797 | A | 5/2008 |
| JP | 2008272086 | | 11/2008 |
| JP | 2010-046238 | | 3/2010 |
| JP | 2010-110450 | | 5/2010 |
| JP | 2011019606 | A | 2/2011 |
| JP | 2011-055859 | | 3/2011 |
| KR | 10-0711544 | | 4/2007 |
| WO | 9626795 | | 9/1996 |
| WO | WO 01/16436 | | 3/2001 |
| WO | WO 2006/055681 | | 5/2006 |
| WO | WO 2007/011747 | A2 | 1/2007 |
| WO | WO 2007/015046 | | 2/2007 |
| WO | WO 2009/039290 | | 3/2009 |
| WO | WO 2009/062546 | | 5/2009 |
| WO | WO 2010/088975 | | 8/2010 |
| WO | WO 2010/089927 | | 8/2010 |
| WO | WO 2010/095250 | | 8/2010 |
| WO | WO 2010/095251 | | 8/2010 |
| WO | WO 2010/119536 | | 10/2010 |
| WO | WO 2011/009156 | | 1/2011 |
| WO | WO 2011/044247 | | 4/2011 |
| WO | 2011074018 | | 6/2011 |
| WO | WO 2011/077625 | | 6/2011 |

OTHER PUBLICATIONS

Bradley Corporation, "Plumbing Fixtures," believed to be publicly available by Mar. 2006, 3 pages.

U.S. Appl. No. 61/198,293 of William M. Louis, Dispenser That Cantilevers Flexible Sheet Material for Horizontal Presentation, filing date unavailable, 16 pages.

U.S. Appl. No. 61/206,768 of William M. Louis, "Swingarm Loading Mechanism for Paper Towel Dispensing Systems," filing date unavailable, 13 pages.

Bradley Corporation, "Bradpack Preassembled Wash Centers," dated Jan. 1986, 12 pages.

"Innovative Applications in Solid Surface," The Journal of the Solid Surface Industry, Jan./Feb. 2002, vol. 8, No. 1, 3 pages.

Brueton advertisement for Undulatus bench, Home Design—The New York Times magazine, 2 pages.

Bradley Corporation, The Bradley Express Lavatory System: "A look, a feel, an idea as solid as granite," healing a designation "© 1996 Bradley Corporation," 4 pages.

Bradley Corporation, Terreon: "Shaping your designs," bearing a designation © 1998 Bradley Fixtures Corporation, 8 pages.

Bradley Corporation, "Plumbing Fixtures," bearing a designation "2001," 11 pages.

International Search Report for International Application No. PCT/US2004/07675 including written opinion of the International Searching Authority, mail date Aug. 6,2004, 7 pages.

International Search Report and Written Opinion for Application No. PCT/US2005/002194, date of mailing May 12, 2005, date received May 18, 2005, 9 pages.

Bradley Corporation, "School Solutions, A higher Dedication to, your Design Needs," © 1999 Bradley Corporation, 6 pages.

Bradley Corporation, "Frequency Lavatory Systems," © Bradley Corp 2005, 4 pages.

Bradley Corporation, "Plumbing Fixtures," publicly available by Feb. 14, 2008, 12 pages.

Bradley Corporation, The ndite™ story, publicly available by Feb. 14, 2008, 2 pages.

(56) References Cited

OTHER PUBLICATIONS

Bobrick Technical Data, "Contura ™ Series Surface-Mounted Soap Dispenser B-4112" dated May 2006, 1 pages.
Bradley Corporation, Total Terreon Concept, © Bradley Corp 2004,2 pages.
Bradley Corporation, Terreon Lav Decks, © Bradley Corp 2004, 2 pages.
Bradley Corporetion, "Express Lavatory Systems," © Bradley Corp 2004, 4 pages.
Bradley Corporation, "Frequency Lavatory Systems," © Bradley Corp 2004, 4 pages.
Bradley Corporation, "Terreon Washfountains," © Bradley Corp 2004, 2 pages.
Bradley Corporation, "Sentry Washfountains," © Bradley Corp 2004, 2 pages.
Bradley Corporation, "Classic Washfountains," © Bradley Corp 2004, 2 pages.
Bradley Corporation, "Multi-Fount WashFountains," © Bradley Corp 2004, 2 pages.
Bradley Corporation, "Application Guide," © Bradley Corp 2004, 2 pages.
Bradley Corporation, Washroom Accessories, believed to be publicly available by Jul. 2007,4 pages.
Bradley Corporation, Commercial Washroom Solutions, believed to be publicly available by Jan. 2006, 4 pages.
Bradley Corporation, Washroom Accessories, believed to be publicly available by Aug. 2003, 8 pages.
Bradley Corporation, Washroom Accessories, believed to be publicly available by Jan. 2006,4 pages.
Bradley Corporation, Plumbing Fixtures, believed to be publicly available by Aug. 2002, 12 pages.
Bradley Corporation, Washroom Accessories, believed to be publicly available by Jan. 2008,4 pages.
Bradley Corporation, "Installation Instructions 2483 Surface-Mounted Towel Dispenser," dated Sep. 4, 2003, 1 page.
Bradley Corporation, "Installation 270 Towel Dispenser/Waste Receptacle," dated Jun. 15, 2008, 2 pages.
Bradley Corporation, "Towel Dispenser/Waste Receptacle Model 227," believed to be publicly available by Jun. 2002, 2 pages.
Bradley Corporation, "Towel Dispenser—Center Pull/Waste Receptacle Model 236," dated Feb. 11, 2005, 1 page.
Bradley Corporation, "Installation 236 Towel/Waste Unit with Center Pull," dated Mar. 9, 2005, 2 pages.
Bradley Corporation, Towel Dispenser Model 2481, dated Dec. 21, 2004,2 pages.
Bradley Corporation, Towel Dispenser Model 2479-000000, dated Mar. 31, 2006, 1 page.
Bradley Corporation, Towel Dispenser Model 2479-110000, dated Feb. 11, 2005, 1 page.
Bradley Corporation, Installation Instructions 2479 Recess-Mounted Towel Dispenser, dated Mar. 3, 2004, 1 page.
Bradley Corporation, "Installation Instructions 2479-11 Surface-Mounted Towel Dispenser," dated Feb. 27, 2004,2 pages.
Bradley Corporation, Towel Dispenser Model 2490, dated Nov. 21, 2005,3 pages.
Bobrick Technical Data, "Contura™ Series Surface-Mounted Paper Towel Dispenser B-4262," dated Jun. 2006, 1 page.
Bobrick Technical Data, "Contura™ Series Surface-Mounted Multi-Roll Toilet Tissue Dispenser B4288," dated May 2006, 1 page.
Bobrick Technical Data, "Contura™ Series Recessed Multi-Roll Toilet Tissue Dispenser B-4388," dated May 2006, 1 page.
Bobrick Technical Data, "Contura™ Series Recessed Paper Towel Dispenser B-4362," dated Nov. 2006, 1 page.
Bobrick Technical Data, "Contura™ Series Recessed Waste Receptacle B-43644," dated Nov. 2006, 1 page.
Bobrick Technical Data, "Contura™ Series Recessed Paper Towel Dispenser and Waste Receptacle B-43944," dated Nov. 2006, 2 pages.
Bobrick Technical Data, "Contura™ Series Surface-Mounted Sanitary Napkin Disposal B-270," dated May 2006, 1 page.
Bobrick Technical Data, "Contura™ Series Recessed Soap Dispenser B-4063," accessed on Mar. 28, 2007, 1 page.
International Search Report for International Application No. PCT/US2008/076875, dated Apr. 3, 2009, 4 pages.
International Search Report and Written Opinion for International Application No. PCT/US2008/076875, mail date Jul. 6, 2009, 21 pages.
Bradley Corporation, "All-In-One-Of-A-Kind" Advocate™ Sell Sheet Brochure. Accessed Apr. 2011at http://bradleycorp.com/advocate/Advocate_Sell_Sheet.pdf. 6 pages.
Bradley Corporation Advocate™ Lavatory System—LA90 Series Manual, document No. 1068. Accessed Apr. 2011at http://www/bradleycorp.com/products/fixtures/lavsystems/advocate/viewproduct.jsp?pgid=1724, © Bradley Corp 2010, 8 pages.
Bradley Corporation Advocate™ Lavatory System—LA60 Series Manual, document No. 1066, Accessed Apr. 2011at http://www.bradleycorp.com/products/fixtures/lavsystem/advocate/viewproduct.jsp?pgid=1724, © Bradley Corp 2010, 7 pages.
Bradley Corporation Advocate™ Lavatory System—LA30 Installation Manual, document No. 215-1657 Rev. A; ECM 09-08-0026. Accessed Apr. 2011at http://www.bradleycorp.com/products/fixtures/lavsystems/advocate/viewproduct.jsp?pgid=1724 , dated Oct. 7, 2009 © Bradley Corp 2009, 20 pages.
PCT/International Search Report and Written Opinion—(Application No. PCT/US2010/051647)—11 pages.

* cited by examiner

HAND DRYER WITH POINT OF INGRESS DEPENDENT AIR DELAY AND FILTER SENSOR

CROSS-REFERENCE TO RELATED APPLICATION

The present application claims priority of U.S. patent application Ser. No. 13/088,512, filed Apr. 18, 2011, the disclosure of which is incorporated herein.

BACKGROUND OF THE INVENTION

The present invention relates generally to the field of lavatory systems and, more particularly, to touch-free hand dryers that use proximity sensors to commence the blowing of air.

In an effort to reduce the waste and frequently the mess associated with paper toweling in public washrooms such as those found in high traffic areas like schools, libraries, airports, train and bus terminals, shopping centers, theaters, and sports venues, wall-mounted electric hand dryers have become prevalent. More recently, proximity sensors have allowed for touch-free hand dryers that can be activated automatically when a user places his hands in a drying zone adjacent the hand dryer; typically, below and/or in front of the hand dryer. For many installations, the hand dryer is mounted on a wall opposite the wash basin and, quite frequently, one or two hand dryers will be provided for a bank (more than two) of wash basins. As a result, a user after cleaning his hands must walk some distance to the hand dryer. This frequently results in water and/or soap dripping onto the floor as the user walks from the wash basin to the hand dryer. As there are typically more wash basins than hand dryers, it is possible that water could pool on the floor during high use periods. The accumulated water can create a slippery and, consequently, potentially unsafe condition. Additionally, the hand dryer can blow water from the user's hands onto the floor during the drying process further adding to the amount of water that accumulates on the floor. Moreover, water and/or soap can accumulate on the countertop supporting the wash basin which can be unsightly, if not quickly addressed. Additionally, the accumulation of water and/or soap on the floor and/or countertop may lead to germ-infested areas thus posing additional health risks as well as creating discomfort for users that are particularly germ sensitive.

One proposed solution is described in U.S. patent application Ser. No. 12/233,466, which is assigned to Bradley Fixtures Corporation, the assignee of this application and which is incorporated herein by reference. The aforementioned application describes a lavatory system in which a hand-washing station has a wash basin, a faucet, and an electric hand dryer. The integration of these components into a single wash station alleviates the need for a user to leave the wash station to access a hand dryer. That is, the hand dryer is adjacent the wash basin and (heated) air is blown into an area generally above the wash basin. Accordingly, a user can water and soap his hands in a conventional manner and then move his hands to the drying zone of the hand dryer. The user's hands do not need to leave the wash basin for the hands to be exposed to the drying air. Hence, water does not drip onto the floor as the user presents his hands to the dryer and water removed from the hands is blown into the wash basin rather than onto the floor.

The lavatory system described in the aforementioned application provides a significant improvement over conventional lavatory systems. However, the present inventor has discovered that many users of such an integrated wash station do not slide their hands over from below the faucet to the drying zone of the hand dryer. The inventor has found that some users, so conditioned to extract their hands from the wash basin entirely, will remove their hands from the wash basin and then present their hands to the front of the drying zone. As the hand dryer is activated when one or more proximity sensors sense the presence of the user's hands, it has been found that such a front-presentment can result in splash-back of water onto the clothes of the user, the floor, or the countertop.

SUMMARY OF THE INVENTION

The present invention is directed to a hand dryer in which the point of entry into a drying zone is detected and used to selectively activate a delay before the hand dryer is activated. While not so limited, in one embodiment, the hand dryer is part of an integrated lavatory system having a wash basin with a faucet operably connected to the wash basin and a soap-dispensing system having a spout operably connected to the wash basin. The hand dryer defines a hand-receiving cavity above the wash basin so that a user does not need to remove his hands from the wash basin to place his hands in the hand-receiving cavity. The hand-receiving cavity has a top portion with an air outlet, and a bottom portion with an air outlet. A blower provides a volume of air to the air outlets which is ultimately presented to the hand-receiving cavity. Multiple proximity sensors are operably connected to the blower and turn the blower on and off when triggered by an object, i.e., detection of the user's hand(s). In one embodiment, a first proximity sensor is positioned adjacent a side of the hand-receiving cavity and thus senses the ingress of a user's hands into the hand-receiving cavity from the side. A second proximity sensor is positioned adjacent the front of the hand-receiving cavity and senses the ingress of a user's hands into the hand-receiving cavity from the front. Depending upon which sensor detects the user's hands, one of two different delays is observed before the blower is caused to force air to the air outlets. In a preferred implementation, a longer delay is observed if the second proximity sensor detects the user's hands.

In an alternate embodiment, each of the sensors has non-overlapping fields-of-view so that only one of the two sensors can detect the presentment of the user's hands.

In another alternate embodiment, detection by the first sensor results in a delay between zero and 300 milliseconds (ms) whereas detection by the second sensor results in a delay between 200 ms and 800 ms, and the delay resulting from detection by the second sensor is preferably selected to exceed the delay resulting from detection by the first sensor.

In a further embodiment, the two aforementioned sensors are replaced with a single sensor capable of discriminately sensing side-presentment or front-presentment of the user's hands to the hand-receiving cavity.

In another embodiment, an air filter and filter flow sensor are also provided.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF PREFERRED EMBODIMENTS

Figure 1:
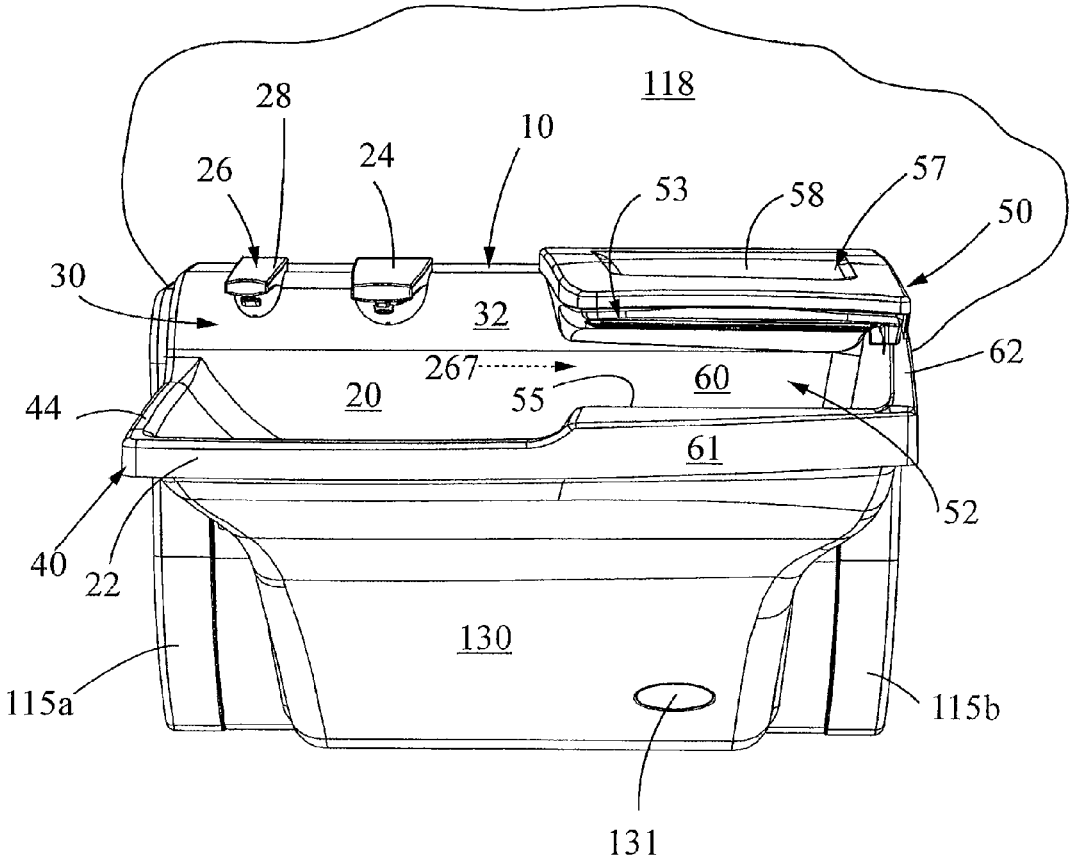
FIG. 1 illustrates a front view of a lavatory system of the present invention.

The present invention will be described with respect to a hand dryer that is part of an integrated lavatory system also having a wash basin, a water faucet, and, optionally, a soap dispenser. However, it is understood that the present invention is applicable with stand-alone hand dryers, such as conventional wall-mounted hand dryers, and may also be desirable for other types of dryers in which it is desirable to delay commencement of a drying cycle based on the presentment of an object for drying to a drying chamber, cavity, or zone. In one preferred embodiment, the present invention is applicable with an integrated lavatory system such as those described in U.S. patent application Ser. Nos. 12/233,466 and 13/122,368 and herein incorporated by reference; however, as noted above, the invention is not so limited.

Turning now to FIGS. 1-24, a lavatory system 10, preferably, has a wash basin 20, including a wash basin wall 22. As shown in FIGS. 1-4, faucet 24 is provided within the wash basin 20. The faucet 24 may include indicia etched thereon such as a water droplet symbol or a faucet light 23 for directing a user. Such indicia may be particularly helpful to a user that has poor eyesight. The faucet 24 may also include a sensor located behind a sensor window 25 which automatically engages a faucet control to provide water to the user. The faucet 24 is connected to plumbing to provide hot and/or cold water to the faucet. Preferably, the water is provided at a comfortable temperature for the user's hands.

A soap dispensing system 26 is near the faucet 24 and in the wash basin 20. The soap dispenser 26 includes a spout 28 and a soap-dispensing sensor (located behind sensor window 29) to detect an object, such as a user's hand 166 (See, e.g., FIG. 20), and to provide soap thereto. Indicia, such as soap bubbles, or a light 27 may also be provided on the spout 28. As best shown in FIG. 1, a countertop 30 is preferably provided above and around the wash basin 20. The soap dispenser or system 26 includes a liquid soap container (not shown) located under the wash basin 20 and countertop 30 and that is connected to the spout 28. A backsplash 32 may also be present and integral with the countertop 30. Thus, the soap container is masked, in part, also by the backsplash 32. Further disclosure of embodiments of the soap dispensing system 26 may be found in co-pending U.S. patent application Ser. Nos. 12/233,466 and 13/088,512 further incorporated herein by reference.

Figure 2:
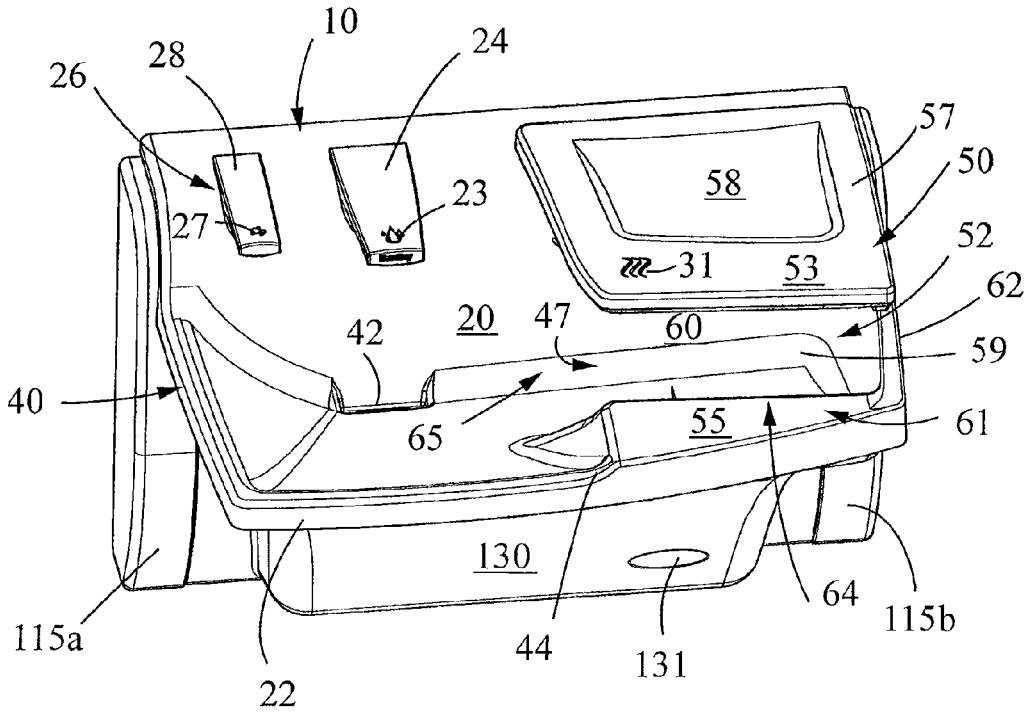
FIG. 2 is a front elevation view of a lavatory system according to the present invention.
Figure 3:
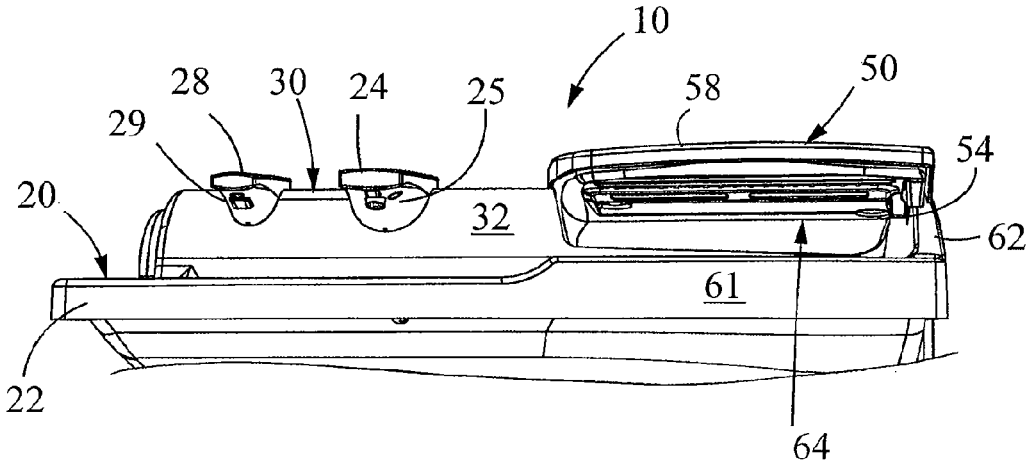
FIG. 3 is a front elevation cutaway view of a lavatory system according to the present invention showing upper portion and hand-washing features.
Figure 4:
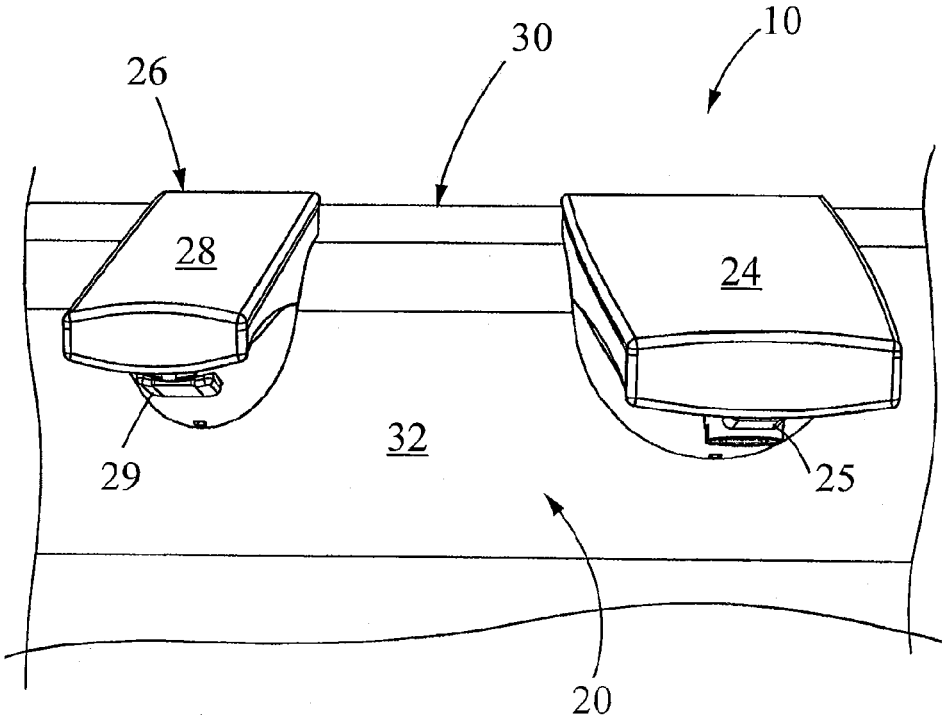
FIG. 4 is a front elevation view of a cutaway portion of the lavatory system according to the present invention showing the faucet and soap dispenser.

As best seen in FIG. 2, preferably a single drain 42, preferably with drain cap, is provided in the wash basin 20. This drain 42 takes soap and water from the wash basin 20 down to a drainpipe (not shown). The drainpipe 127 is preferably located directly under the wash basin 20 (see, e.g., FIG. 18).

As seen in FIGS. 5-9, the lavatory system 10 preferably includes an integral drying system, e.g., a hand dryer 50. The dryer 50 has a hand-receiving cavity 52 and a motor 74. In one preferred embodiment, a mechanism 40 for preventing flooding and damage to the motor 74 is provided. The mechanism 40 may include a flood relief rim or overflow lip 44 located on the wash basin 20, see, e.g., FIG. 6A. The flood relief rim 44 is provided below the lower portion's air outlet 56 and the nozzle tips 162*b* as shown. Thus, water that cannot make it down the drain 42 will flow over the flood relief rim 44 and not down the nozzle holes 162*b* and into the motor 74. Other motor protection and flood prevention mechanisms 40 will be described further below.

Referring now to FIG. 2, the hand dryer 50 may be provided with etched instructional indicia, a heat wave symbol, or light 31. A drain conduit 47 is preferably present to fluidly connect the hand-receiving cavity 52 and wash basin 20. The conduit 47 removes excess water left from the user's hands through the hand-receiving cavity 52 down toward the single drain 42 in the wash basin 20. This water then travels down the drainpipe 127, see, e.g., FIG. 18.

Figure 5:
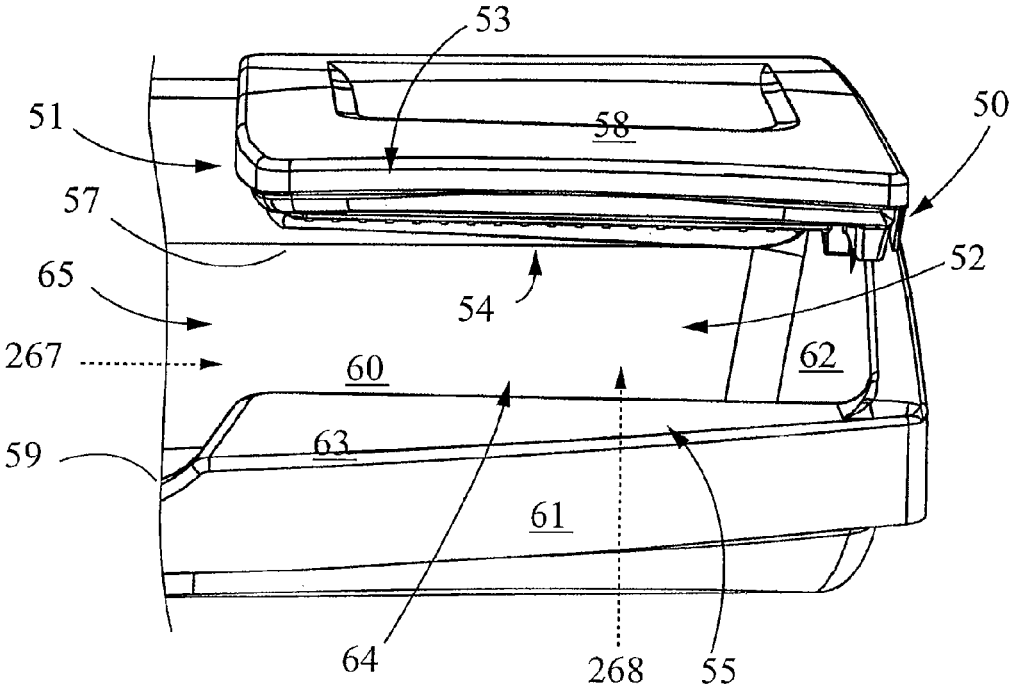
FIG. 5 is a front elevation view of a cutaway portion of the lavatory system according to the present invention showing the upper portion and upper air outlet.

As best seen in FIG. 5, the hand dryer 50 is preferably provided with a top portion 53 and a bottom portion 55. The top portion 53 may also include a hood 51 with a base which forms a top wall 57 of the cavity 52. The top portion hood 51 may also include a top portion cover which may form a shelf 58. An upper air outlet 54 is also provided in the upper portion 53.

Figure 6A:
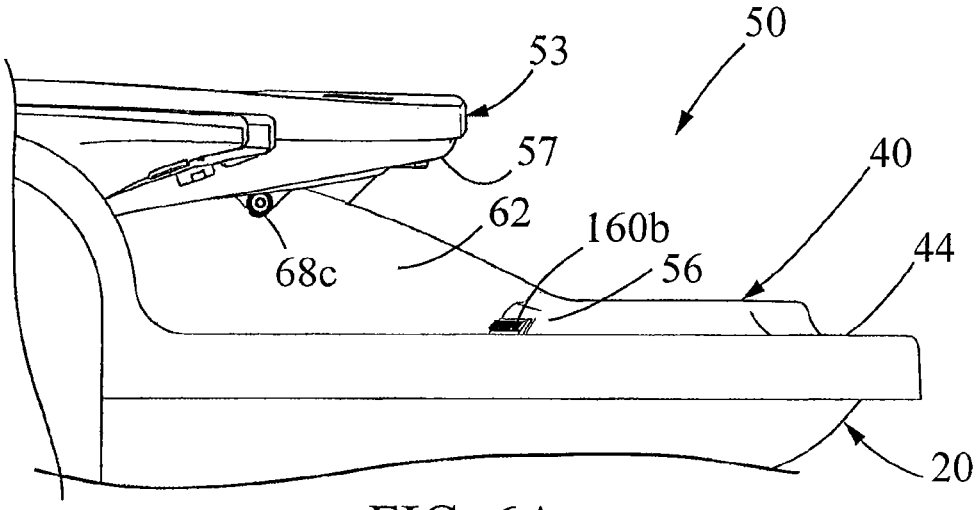
FIG. 6A is a side view of a cutaway portion of the lavatory system according to the present invention showing the upper portion, lower nozzles, and basin.
Figure 6B:
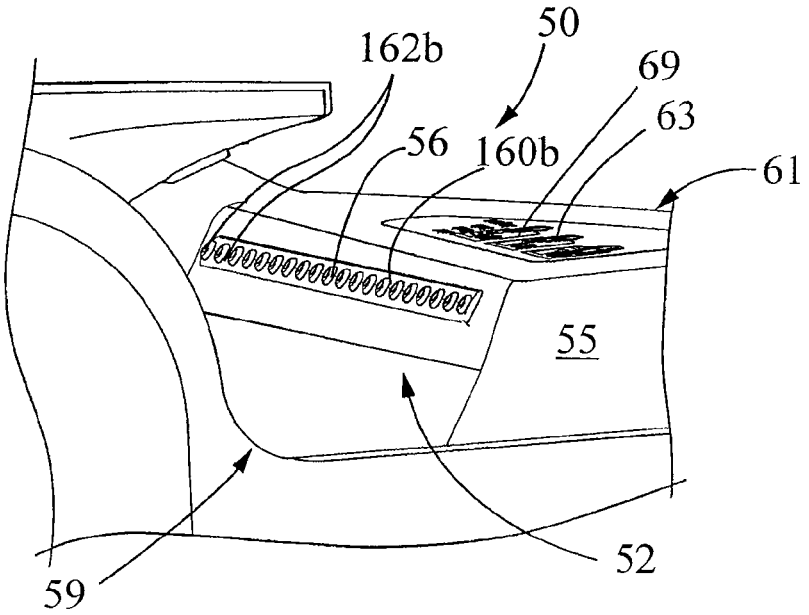
FIG. 6B is a side view of a cutaway portion of the lavatory system according to the present invention illustrating the hand dryer and lower nozzle tips.

As best shown in FIGS. 5, 6A, and 6B, a bottom portion 55 includes a lower air outlet 56. The bottom portion 55 is formed, in part, by bottom wall 59. The bottom portion 55 of the hand-receiving cavity 52 preferably also includes a back wall 60, front wall 61, and single side wall 62 (see, e.g., FIG. 5). A front ledge 63 is preferably integral with the front wall 61. The hand-receiving cavity 52, therefore, is preferably configured to have a front opening 64 and a single side opening 65 (herein the left side) and to allow users to enter their hands at a generally oblique angle. Further, instructions 69 for using the hand dryer may provided on the front ledge 63 as shown in FIG. 6B.

Figure 7:
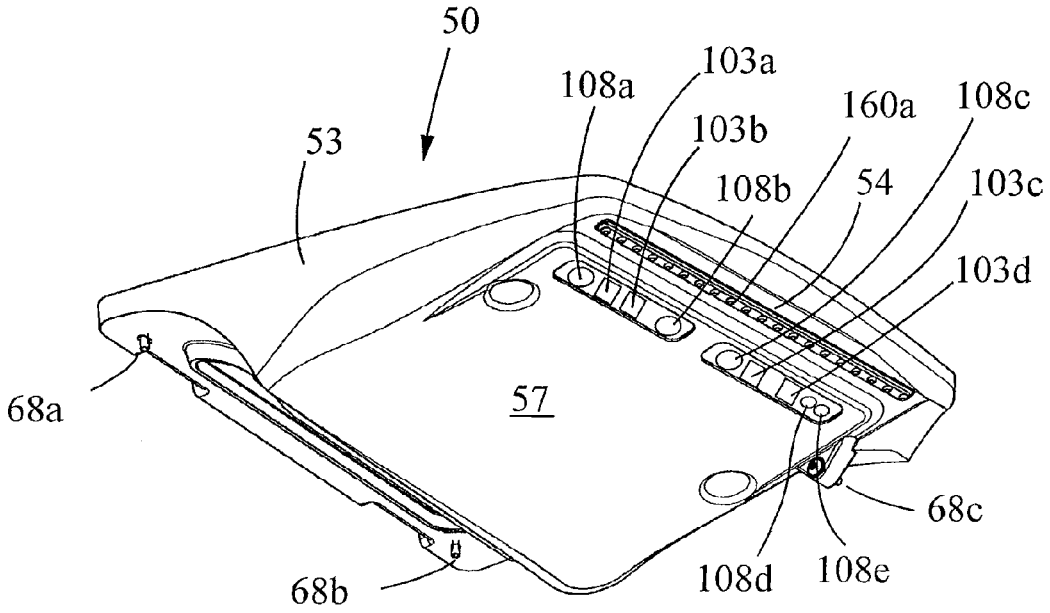
FIG. 7 is a partially exploded lower view of the hand dryer showing the top portion, upper air outlet, and hand dryer sensors.

As best shown in FIG. 7, one embodiment includes a top wall or base 57 that attaches to the backsplash 32 (not shown) and countertop 30 (not shown) preferably with bolts 68*a* and 68*b*. A side anchoring screw 68*c* is also provided to attach the top portion 53 to side wall 62 (see, e.g., FIG. 9). The top portion 53 preferably also has multiple sensors 103*a-d* and LED lights, e.g., 108*a-e* located therein and preferably covered by a window to protect them from splashing water and debris.

Figure 8:
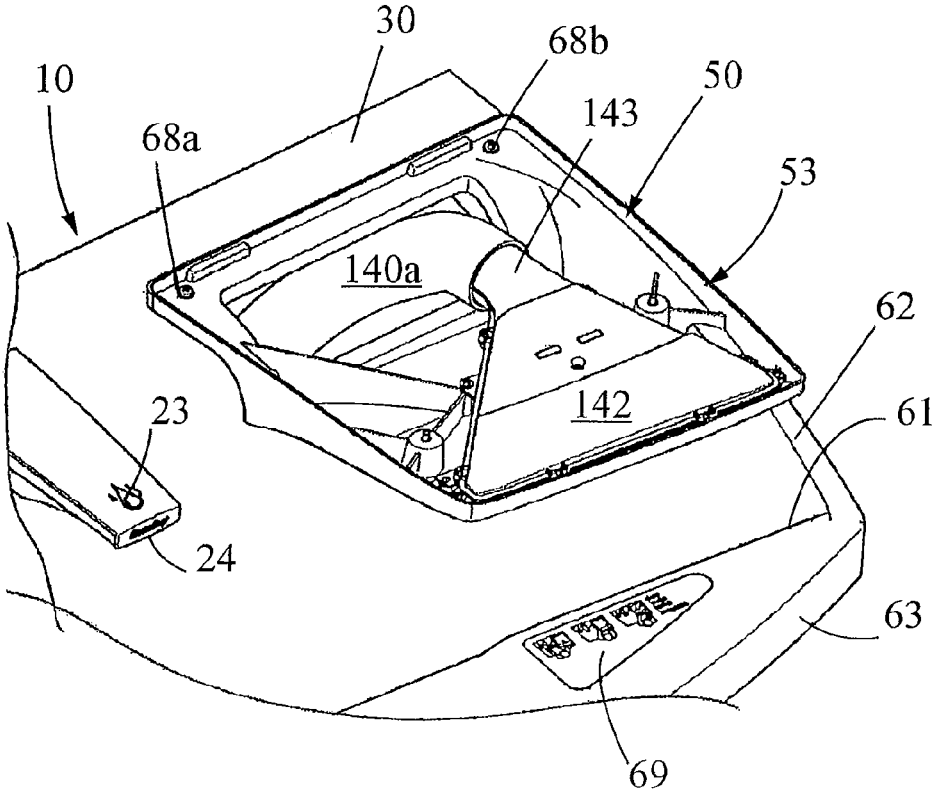
FIG. 8 is a partially exploded upper view of the top portion showing the upper plenum.

FIG. 8 shows the top portion 53 of the hand dryer 50 with the top cover 58 removed. Inside the top portion 53 is a hose 140*a* which attaches to a first or upper plenum 142. The hose 140*a* is connected to the first or upper plenum air inlet 143 (see, e.g., FIG. 11) to provide air to the upper plenum 142.

Figure 9:
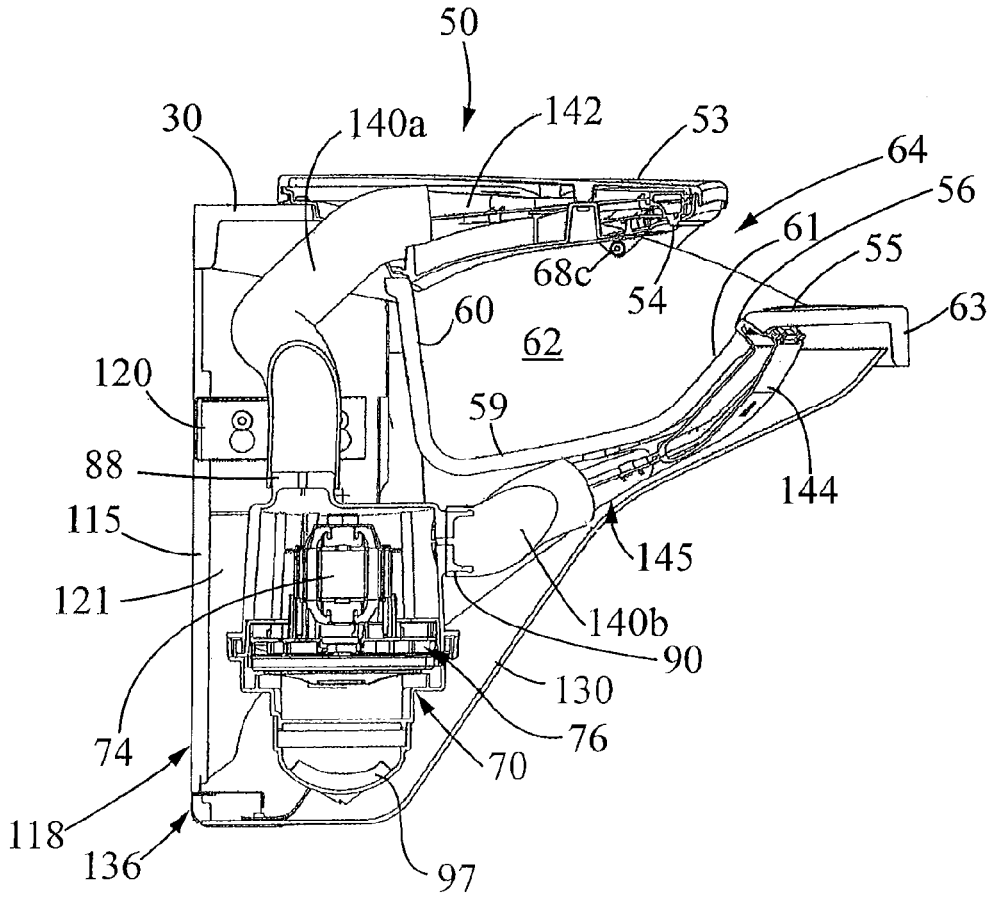
FIG. 9 is a side cross-sectional view of the lavatory system showing the hand dryer, motor, upper plenum, and lower plenum.
Figure 10:
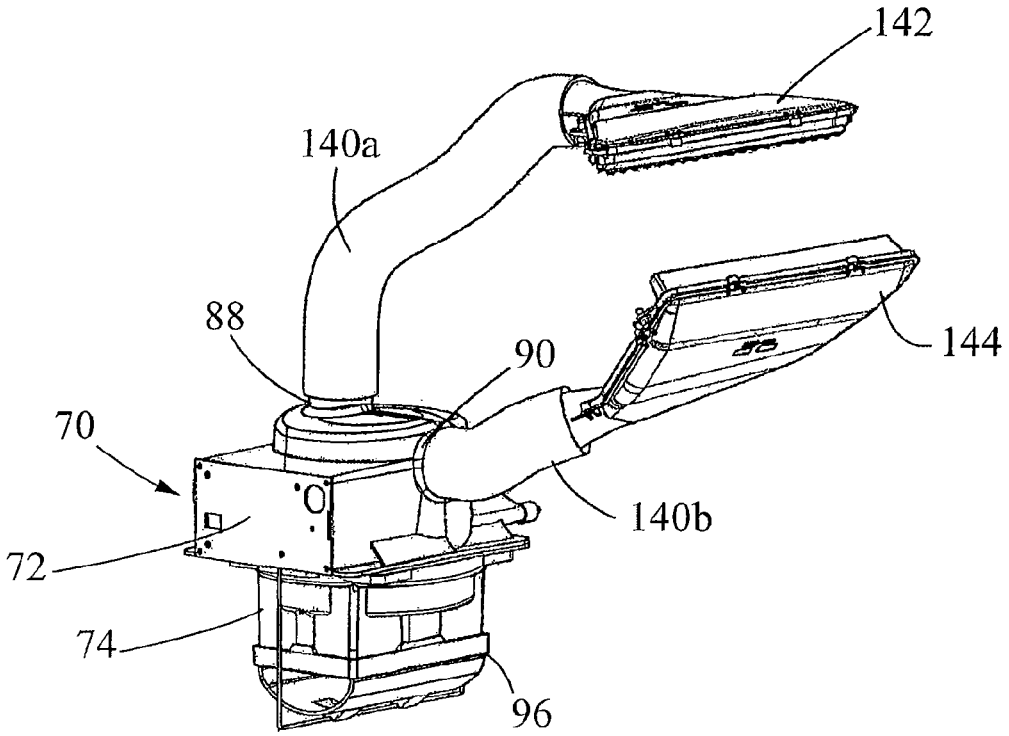
FIG. 10 is a view of the lavatory system showing the hand dryer motor, upper plenum, and lower plenum.

As shown in FIGS. 9 and 10, a second, or lower plenum 144, is also provided. The lower plenum 144 is connected to a hose 140*b* which delivers air to the lower plenum 144 via a lower plenum air inlet 145. The preferably flexible hoses 140*a* and 140*b* are attached to a first outlet port 88 and a second outlet port 90 which are preferably on or part of a motor housing 70. A blower 71 including a motor 74 with a fan 76 (see, e.g. FIGS. 15 and 16), provides air to the hand dryer 50. The air outlets 54, 56 are configured in such a way so that they provide air into the hand-receiving cavity 52 (see, e.g., FIGS. 5 and 6B) downwardly and back toward the back wall 60. For example, in one embodiment, the two outlet or exhaust ports 54, 56 are offset from one another in horizontal planes, i.e., the lower plenum 144 nozzle holes 164*b* are at about a 37 degree angle from horizontal and located closer to the user than the upper plenum 142 nozzle holes 164*a* which are at about an angle of 1 degree rearward from vertical and located closer to the backsplash 32 of the hand dryer cavity 52. This configuration prevents water from splashing onto the user once it is removed from the user's hands. FIG. 10 shows the motor 74 and motor housing 70 operably connected to plenums 142, 144. As shown, the motor housing 70 preferably has an aluminum cover plate 72 and an intake cover 96.

Figure 11:
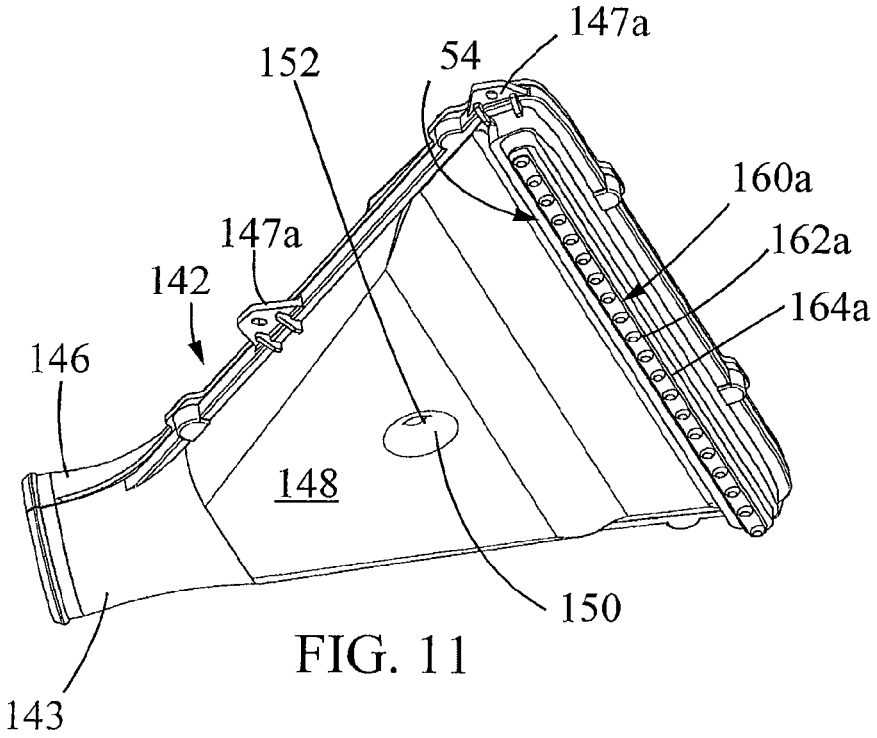
FIG. 11 is a lower view of the hand dryer upper plenum of the lavatory system according to the present invention.
Figure 12:
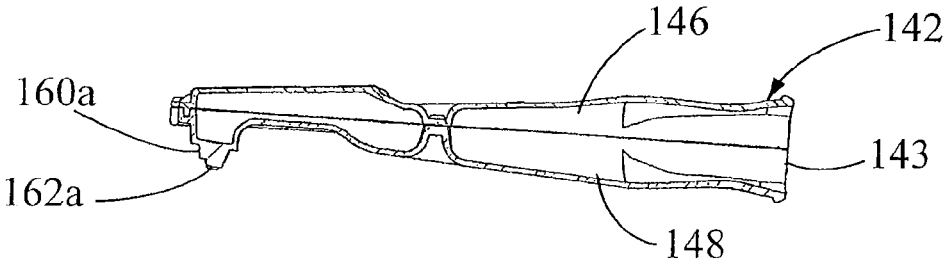
FIG. 12 is a side cross-sectional view of the hand dryer upper plenum of the lavatory system according to the present invention.

FIGS. 11 and 12 show the upper plenum 142 in detail. The upper plenum 142, preferably, is constructed of top piece 146 and a bottom piece 148. The upper plenum air inlet 143 is preferably integral with the upper plenum's 142 top piece 146 and bottom piece 148. A center post 150 and a screw 152 may be used to connect the top piece 146 to the bottom piece 148. Plastic bonding techniques, such as adhesives, may also be used. Additional screws and posts may also be provided along the outside of the plenum 142. The plenum 142 preferably has top nozzles 160*a* molded into it to provide the top portion upper air outlet 54. The top nozzles 160*a* preferably include pointed or frustoconical nozzle tips 162*a* that have nozzle holes 164*a* therethrough. The upper plenum 142 has multiple projections or tabs 147*a* protruding therefrom. The projections 147*a* act as connecting points for screws to attach the plenum to the lavatory system 10.

Figure 13:
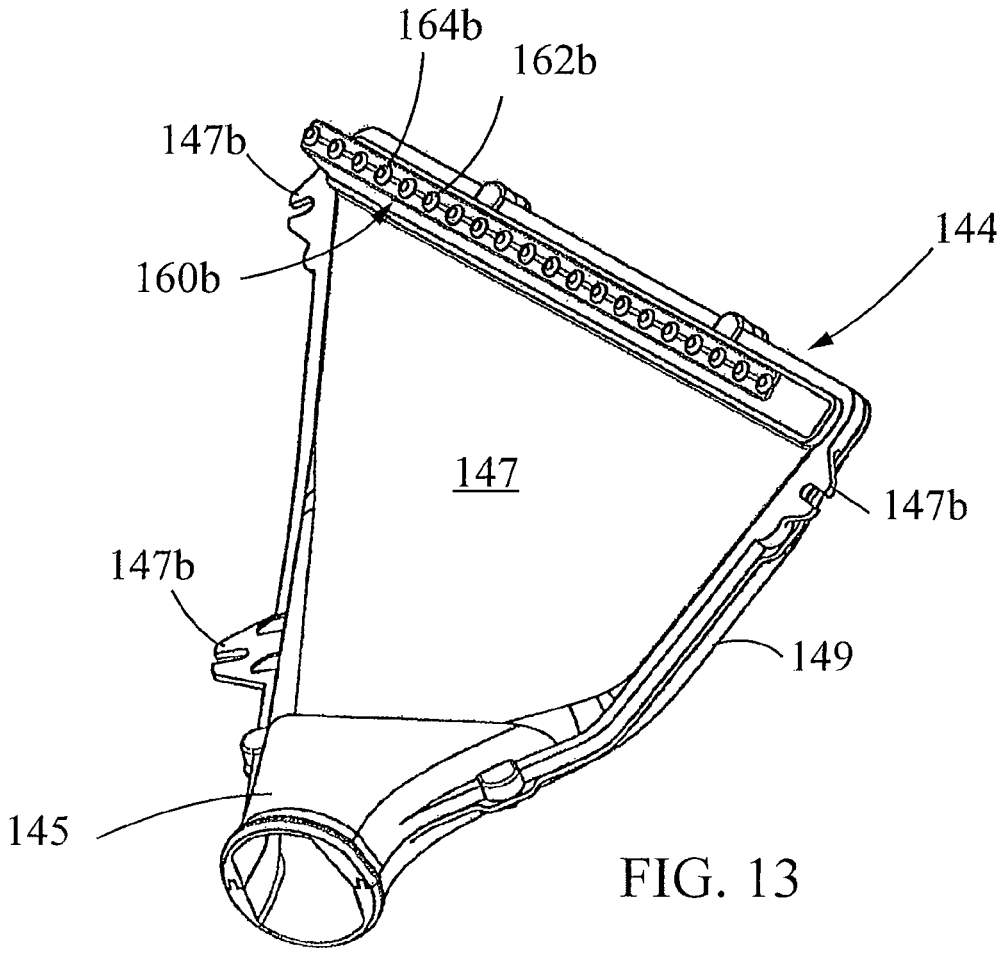
FIG. 13 is a view of the hand dryer lower plenum of the lavatory system according to the present invention.
Figure 14:
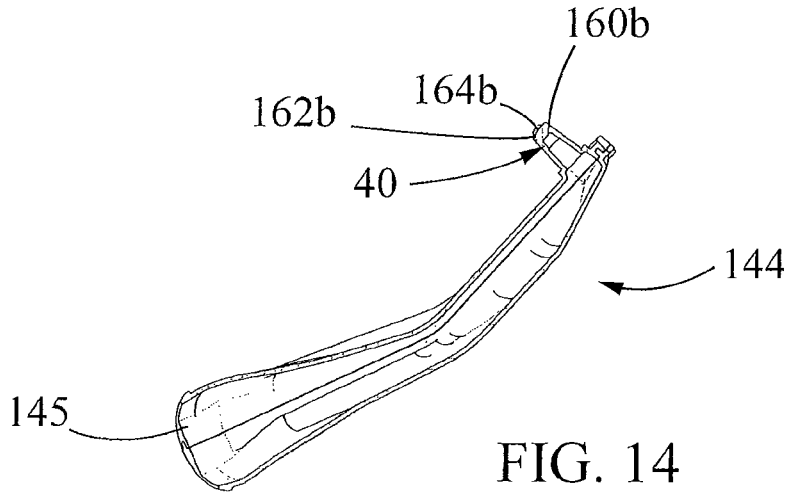
FIG. 14 is a side view of the hand dryer lower plenum of the lavatory system according to the present invention.

As shown in FIGS. 13 and 14, the lower plenum 144 is similarly configured. The lower plenum 144 has a top piece 147 connected to a bottom piece 149, preferably, by bonding and/or posts and screws. A lower plenum air inlet 145 is also provided. The lower plenum air inlet 145 is preferably integral with the rest of the lower plenum 144. The lower plenum 144 also has multiple projections or tabs 147*b* protruding therefrom which act as connecting points for screws to attach the plenum 144 to the lavatory system 10. The upper plenum 142 and the lower plenum 144 are preferably each constructed of two injection-molded plastic top and bottom pieces bonded and/or screwed together. Each plenum may also contain a center post screw (not shown) to minimize deflection of the plenum when pressurized.

Bottom nozzles 160*b* are provided, again, preferably by molding into the lower plenum 144. Lower nozzles 160*b*, like the upper nozzles 160*a*, preferably have protruding frustoconical nozzle tips 162*b* each of which has a nozzle hole 164*b* therethrough. The shape of the nozzle tips 162*b* on the lower plenum 144 further acts as a flood prevention mechanism 40 to protect the motor 74.

Figure 15:
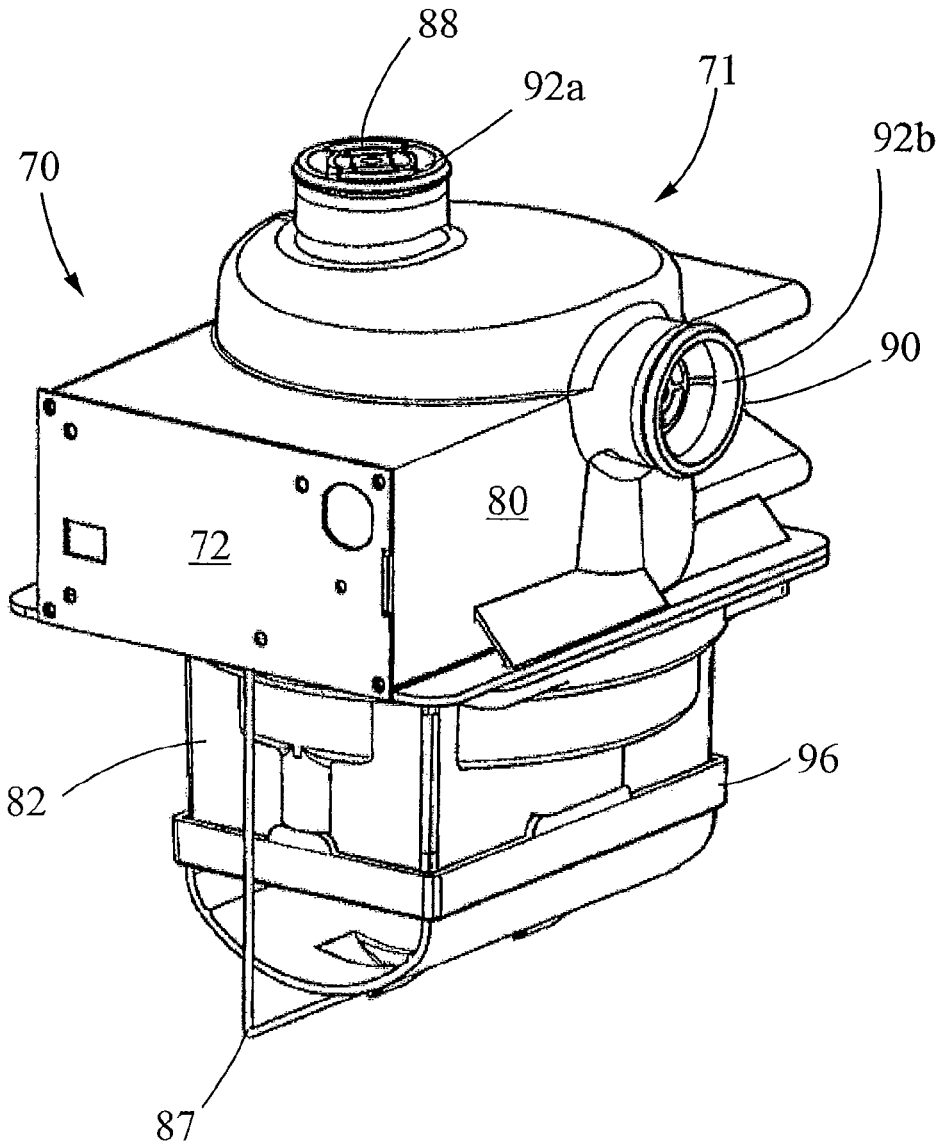
FIG. 15 is a view of the hand dryer motor of the lavatory system according to the present invention.
Figure 16:
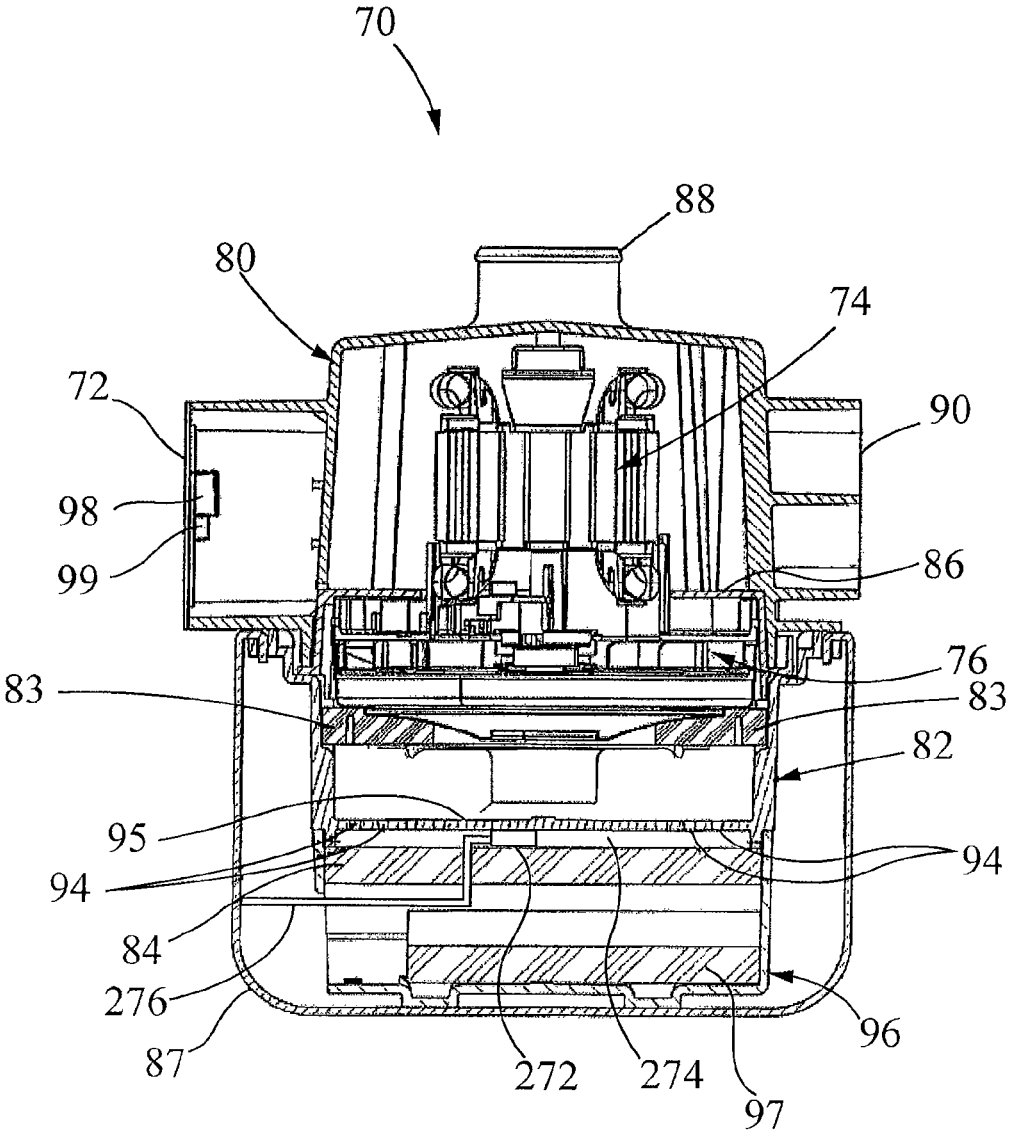
FIG. 16 is a side cross-sectional view of the hand dryer motor of the lavatory system according to the present invention.

The hand-dryer blower 71, motor 74, and motor housing 70 are best shown in FIGS. 15 and 16. Motor housing 70 includes an aluminum cover plate 72 and an upper or outer casement 80. An intake air manifold cap or housing cap 82 is provided toward a lower end of the motor housing 70. The motor 74 is inside the motor housing 70 and has a fan 76 with blades (not shown) to blow air. Preferably, a rubber motor mounting ring and/or housing isolation gasket 86 is also provided. This gasket 86 helps reduce vibrations and deaden the motor's sound. A filter 84 is preferably provided within the housing 70 to filter the intake air. The filter 84 is preferably constructed of HEPA media or some other suitable media. Also contained within the motor housing 70 is acoustic insulation foam 83 to further isolate and lessen motor noise. The motor may be electronically commutated to eliminate the exhaust of worn carbon through the air passages of the hand dryer system and toward the hand dryer user's hands.

The intake air portion or lower portion of the motor housing cap 82 is configured with a solid center section 95 surrounded by a circular pattern of holes 94. This configuration is spaced at a distance similar to the half wave length of the fan blade passing frequency of the fan motor 74. As a result, acoustical waves are reflected off of the solid center section 95 on the bottom of the housing cap 82 at a fan cowling and the acoustical foam 83, and eventually propagate through the circular hole pattern 94 in an attenuated manner.

A filter or intake cover 96 may also be provided in the housing 70 to contain or to hold the filter 84 in place. To further attenuate sound generated by the fan motor 74, insulation or acoustical foam 97 is placed on the inside of the intake cover 96. The cover 96 is preferably further configured to redirect the intake air 90 degrees from the axial center of the fan 76 and motor 74. This design promotes reflection of acoustical waves off of the noise-reducing acoustical foam 97. A wire or other locking mechanism 87 is provided to keep the filter cover 96 in place.

As shown in FIG. 15, the first outlet port 88 and second outlet port 90 may include first outlet port grate 92*a* and second outlet port grate 92*b*, respectively, to prevent fingers or hands from accidentally being pushed into the motor 74 (not shown). These grates are preferably integrally molded into the port outlets.

Referring to FIG. 16, in one preferred embodiment, a motor control board or circuit board 98 is contained in the housing 70 and includes a motor control, a controller 99, or, e.g., a microcontroller, for turning the motor on/off and further controlling the motor 74. This controller 99 may be in communication with several other sensors and/or subsystems, as will be described more fully below. The board 98 is preferably in communication with aluminum plate 72 which acts as a heat sink to channel heat away from the board 98. The plate 72 also acts as mounting platform for the board 98.

Figure 18:
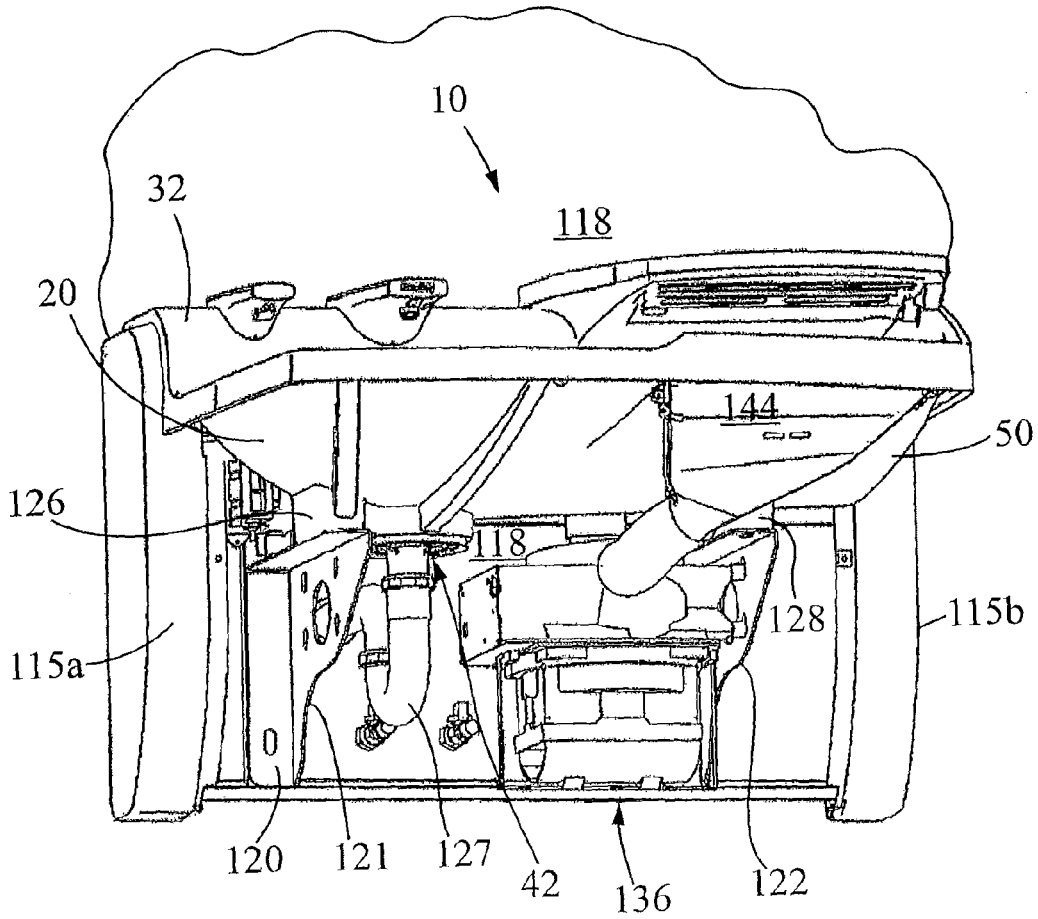
FIG. 18 is a lower front view of the lavatory system according to the present invention with a cover removed to show the mounting hardware.

As shown in FIG. 18, the lavatory system 10 is preferably attached to a lavatory wall 118 and can be mounted at different heights to accommodate adults, children, and those with disabilities. A frame 120 may be connected to the lavatory wall to support the lavatory system 10. The frame 120 preferably has two triangular-shaped brackets 121, 122 having flat surfaces, support columns 126, 128 on an underside of the wash basin 20 and hand dryer portion 50. A drain pipe 127 connects the drain 42 (see, e.g., FIG. 2) to the lavatory's plumbing behind the lavatory wall 118. Screws or other fastening means secure the brackets in place.

The frame 120 and drain pipe 127 are preferably covered by a lavatory system cover 130 (as best seen in FIGS. 1 and 2). The lavatory system cover 130 not only conceals the frame, motor, electrical connections, and plumbing, but it also preferably reduces the sound level experienced by the user. The cover 130 preferably also has brand indicia 131 and other user instructional indicia contained thereon. First end cap 115*a* and second end cap 115*b* help secure the cover 130 to lavatory system 10. The end caps 115*a*, 115*b* are preferably made of stainless steel and the cover 130 is preferably made of a plastic and/or resin material, e.g., a Class A fire-rated polymer. A primary air inlet 136 (see, e.g., FIG. 9) is preferably provided by creating a small gap between the lavatory wall 118 and the cover 130. The gap provides noise attenuation and also prevents foreign objects from getting sucked into the primary air inlet 136.

Figure 19:
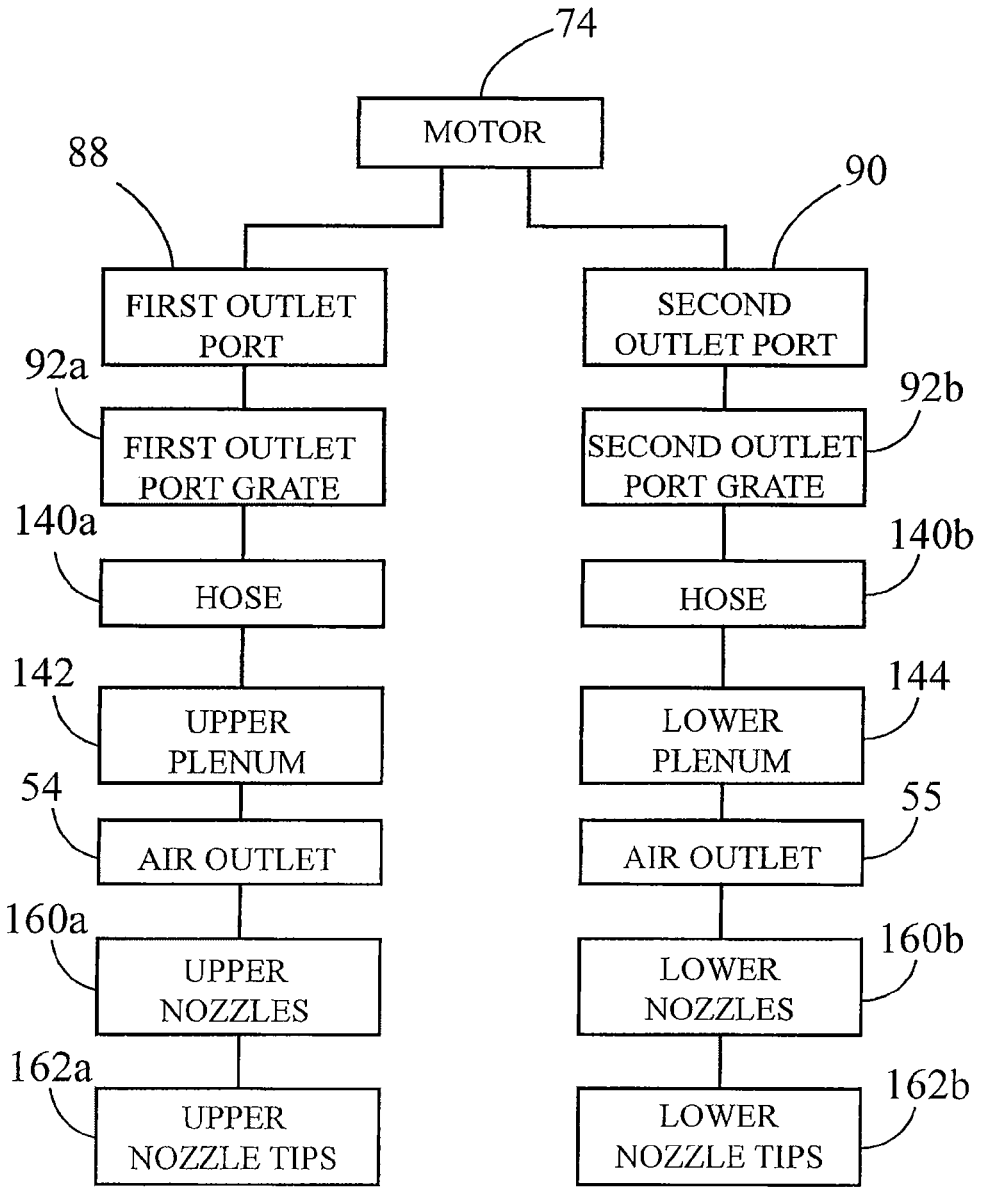
FIG. 19 is a block diagram showing a preferred air flow path from the hand dryer motor.

FIG. 19 is a diagram showing a preferred air flow for the blower 71 from the motor 74 and fan 76 out the first outlet port 88 and second outlet port 90. From the first outlet port 88, the air travels up through a grate 92*a* and via a hose 140*a* to a first or upper plenum 142 and out an air outlet 54. The air outlet 54 channels the air through individual upper nozzles 160*a* having upper nozzle tips 162*a* with air holes and into columns of air directed downwardly at a user's hands in the cavity. From the second outlet port 90, the air travels through a second outlet port grate 92*b* and via a hose 140*b* to a second or lower plenum 144 and out an air outlet 56. The air outlet 56 channels the air up through lower nozzles 160*b* having lower nozzle tips 162*b* with air holes and into columns of air directed outwardly at a user's hands in the cavity.

In a preferred embodiment, upper and lower nozzle tips 162*a*, 162*b* connected to the nozzles 160*a*, 160*b* emit high-speed colliding columns of air to shear water off the user's hand. The tips, holes, and resulting air columns are spaced and calibrated in such a way as to reduce forces on the user's hand which would otherwise move the hand toward the upper or lower plenums or the side surfaces. As mentioned, one way of accomplishing this spacing and calibration is to have the axis of the air flow from upper plenum 142 nozzle holes 164*a* angled about 1 degree from vertical and aimed toward the cavity back wall 60 (FIG. 9) and the axis of the air flow from lower plenum 144 nozzle holes 164*b* angled about 37 degrees from horizontal and aimed toward the cavity back wall 60. Moreover, the upper to lower nozzle tip spacing may be about 3.5 inches apart and the hand-receiving cavity 52 (see, e.g., FIG. 5) may have width of about 9.5 to 10 inches to provide the user with optimal comfort when using.

In one embodiment, the nozzles 160*a*, 160*b* preferably have tips 162*a*, 162*b* that are pointed protrusions that help pull static air into the air columns, see, e.g., FIGS. 12 and 14. These rows of nozzles are preferably mounted on two, approximately ten (10) inch, rectangular blocks or blades that fit, respectively, into the top and bottom air outlets 54, 56. The blades are preferably integral with the upper and lower plenums 142, 144. There are approximately 20 nozzles with tips formed or molded into each blade. These tips are approximately 0.050-0.060 inches long and have a diameter at the base of approximately 0.160-0.220 inches. The holes therein are preferably about 0.101 inches in diameter. From the center of one nozzle hole to the center of the next nozzle hole, it is preferably about 0.50 inches. As mentioned, the tips 162*a*, 162*b* preferably have a generally frustoconical shape to help prevent water from entering the nozzles 160*a*, 160*b* and also have about a 6 degree taper. In one preferred embodiment, the tips have a smooth, slightly rounded side wall to prevent catching of clothing or jewelry. When the dryer 50 is in use, the user's hands are preferably about 0.75 inches away from the nozzle tips.

As discussed, in one embodiment, the nozzles and holes on the top blade and the nozzles and holes on the bottom blade are at different angles from the horizontal plane and vertically aligned with one another so that the collision of the upper and lower streams of air provide a unique air flow pattern. This configuration preferably helps to generate an s-shaped airflow pattern. However, in another alternative embodiment, the holes and nozzles are lined up directly across the cavity from each other.

In one embodiment, the preferred bidirectional or dual-sided air flow dryer uses 1600 watts (or 13.7 amps) and will dry hands in about 15 seconds at 80 decibels (dB) with 70 cubic feet per minute (CFM). In this embodiment, the dryer runs off a 120V outlet and requires a dedicated 20 ampere (amp) circuit. Ground fault interruption (GFI) circuit protection is preferred. It is understood, however, that the invention is not limited to the above-referenced parameters. For example, it is contemplated that the dryer could run on a 15 amp circuit.

Figure 17:
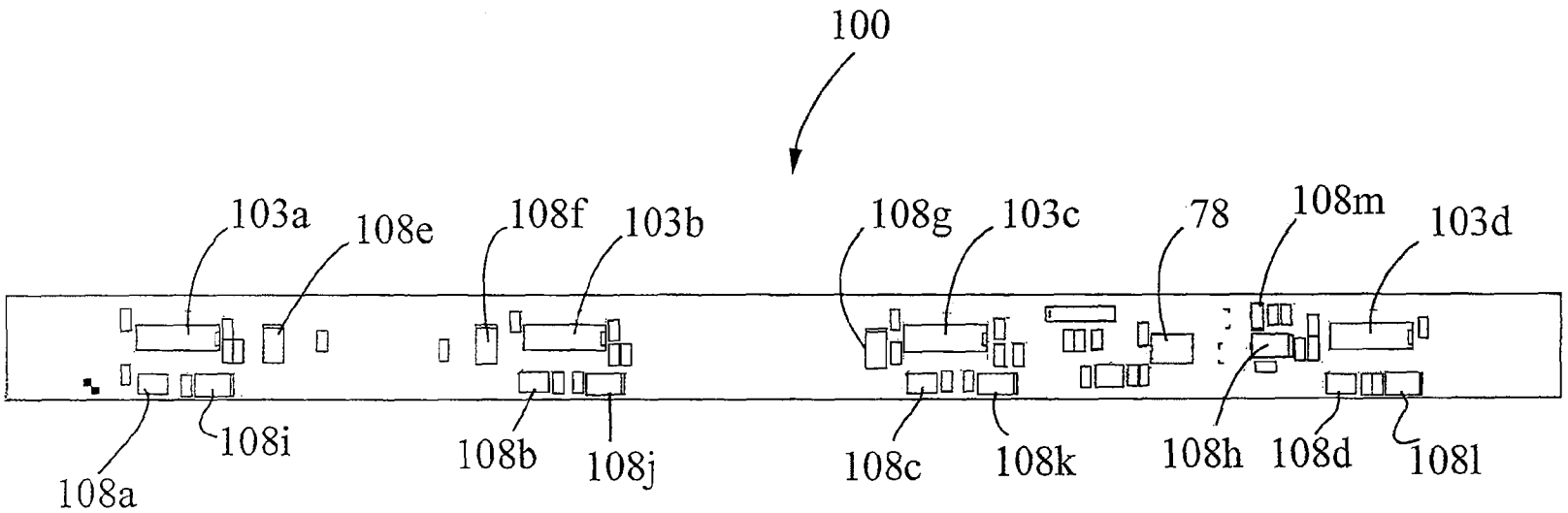
FIG. 17 is a view of the sensor board of the lavatory system according to the present invention.

Referring now primarily to FIG. 17, a sensor control board 100 is preferably provided in the top portion 53 near the upper plenum 142 (see, e.g. FIG. 9). The sensor control board 100 includes a controller 78, e.g., a microcontroller, and a multitude of sensors 103*a*, 103*b*, 103*c*, 103*d*. In the preferred embodiment, four proximity sensors (e.g., first, second, third, fourth proximity sensors) are provided in series. These work independently through triangulation to detect an object for drying 166, e.g., a user's hands, in the cavity 52 (see, e.g., FIG. 5). Lights or LEDs 108*a-m* may also be mounted to the control board 100. Some or all of the LEDs, e.g., LEDs 108*a-l*, may be activated when the first through fourth proximity sensors 103*a-d* detect an object for drying in the hand-receiving cavity 52.

In one preferred embodiment, the LEDs 108*a-m* are operably connected to the hand dryer 50. For example, LEDs 108*a-d* continuously illuminate the hand-receiving cavity 52 at a low intensity level when a sensor does not detect the presence of an object for drying, i.e., the cavity is not in use or in "stand-by". However, when a sensor detects that an object for drying has entered into the hand-receiving cavity 52, and during dryer 50 activation, preferably the LEDs 108*e-h* and 108*i-l* also illuminate cavity and thus increase the overall intensity level of light in the cavity. In another embodiment, LEDs 108*a-d* do not begin to illuminate the cavity until the soap is dispensed or the water begins to flow in the basin.

In a preferred embodiment, when a staff member wishes to clean and service the lavatory system 10, the staff member may engage a service mode. Here the LEDs 108*a-d* and 108*e-h* continuously illuminate the hand-receiving cavity 52. Activation of hand dryer 50 is also suppressed by communication between controller 78 and controller 99. In one embodiment, service mode activation is accomplished by triggering a sensor, e.g., the right-most sensor 103*d* in the upper portion of the hand-receiving cavity 52, for an extended time period. Thus, if this one sensor consistently detects an object for drying in the hand-receiving cavity 52, the hand dryer 50 is disabled for about 30 to 60 seconds and some of the LEDs, e.g., LEDs 108*e-h*, may be illuminated at a high-intensity level. This allows the hand-receiving cavity 52 to be temporarily cleaned without further engaging the hand dryer 50.

The LEDs, e.g., 108*i-l*, may flash in certain ways when the service mode has been started and/or is about to end. For example, in one embodiment, prior to the service mode, one row of four white LEDs provides lower level illumination of the hand dryer cavity. However, if the right-most sensor is triggered within the last 2 seconds, and if a hand is placed over the right-most sensor for the period of 3 seconds, a row of four amber LEDs will rapidly flash twice to designate that the unit is entering the service mode. At the same time, a second row of four white LEDs will turn on to increase the illumination of the hand cavity for approximately 30 seconds to assist in cleaning. After approximately 25 seconds from when the service mode was started, the row of four amber LEDs will flash three times to indicate that the service mode cycle is nearing completion. At the end of the service mode cycle (5 seconds after the four amber LEDs flash three times or about 30 seconds in total service cycle length), the second row of white LEDs will turn off and the hand dryer cavity will remain lit at the lower level of illumination by the first row of four LEDs.

In one embodiment, the service mode includes a controller 78, e.g., a microcontroller, with a programmed touchless cleaning mode feature wherein if one sensor is the only sensor activated within the last two seconds and if activated continuously for about three (3) seconds, the hand dryer 50 will enter the mode to allow cleaning of the hand dryer 50. This mode lasts for about 30 seconds, during which dryer activation is suppressed, and then the controller will return the system to normal operation. The controller will flash the LED lights twice when entering the cleaning mode and three times when approaching a time near the end of a cleaning cycle which is approximately 25 seconds into an about 30 second cleaning cycle. If the cleaning mode is longer in another embodiment, the lights will flash three times, 5 seconds before the end of the cleaning cycle.

Figure 20:
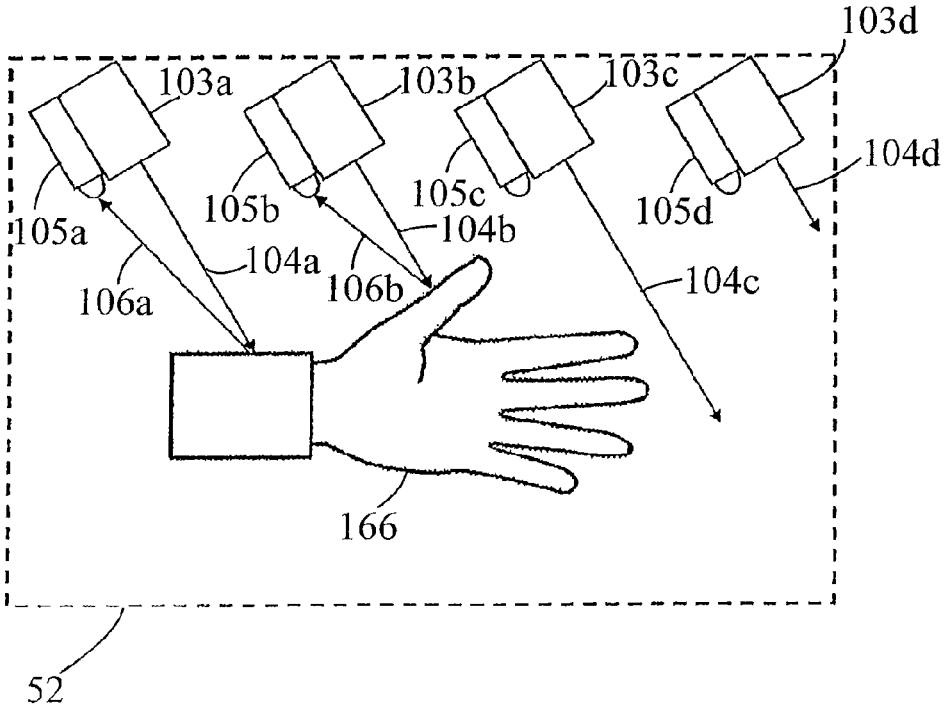
FIG. 20 is a diagram showing the hand dryer sensors according to the present invention interacting with a hand.

FIG. 20 is a diagram showing triangulation of the sensors 103*a*-103*d* in detecting an object for drying in the hand-receiving cavity 52, e.g., a user's hand 166. In a preferred embodiment, it should be noted that hand entry occurs at an oblique angle. Hand 166 entry angles range from approximately 5 to 50 degrees from horizontal depending on the user's height and the mounting height of the lavatory system 10. For example, sensors 103*a-d* may be infrared (IR) sensors with emitter sections emitting IR light 104*a-d*, respectively. The IR light 104*a* and 104*b* may be reflected by hand 166. Each IR sensor 103*a-d* also has a detection module 105*a-d*, respectively.

The sensor detection modules 105*a* and 105*b* utilize an internal triangulation algorithm to sense IR light, 106*a* and 106*b* respectively, when an object for drying is in the sensor's field of view. When a user's hand 166 enters the hand-receiving cavity 52, the sensor detection modules 105*a* and 105*b* output an electrical signal (e.g. a 5 volt signal). This signal is used by the controller 78 to determine whether to activate the hand dryer (50) and LED lights 108*e-l* (see FIG. 17).

Figure 21:
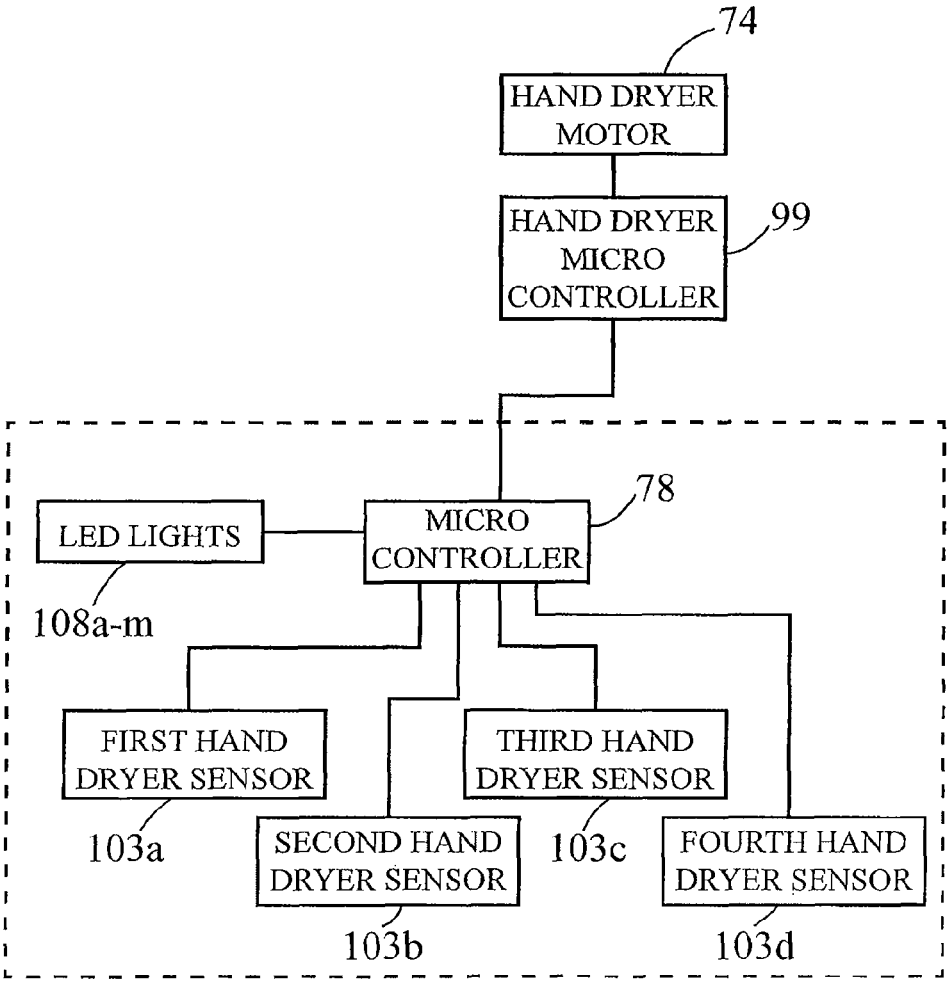
FIG. 21 is a block diagram showing the hand dryer electrical components.

FIG. 21 is a diagram showing a preferred electronic control communications embodiment. In this embodiment, at least one controller 78 communicates with the various subsystems, e.g., the first, second, third, and fourth hand dryer sensors 103*a-d*, LED lights 108*a*-1, and hand dryer 50 (including hand dryer motor's controller 99). In this embodiment, the controller 78 may include a pre-programmed programmable unit having a time delay mechanism for turning the subsystems on and off in a certain sequence. Of course, it is appreciated that one or more controllers may be used, for example, one for each subsystem, and may therefore be configured to communicate with each other. In one embodiment, a sensor control board or circuit board 100 (see, e.g., FIG. 17) is provided and includes a controller 78 and a single bank of sensors (103*a-d*) to measure distance by triangulation. There may also be present on this sensor control board 100, LEDs 108*a-d* that will continuously illuminate the hand-receiving cavity 52. LEDs 108*e-h* and LEDs 108*i-l* may also be present and illuminate when the sensors 103*a-d* detect a user's hand 166 in the cavity. In one embodiment, white lights are used when the dryer is in standby, and amber lights are used when the dryer is in use.

A programmable unit may be present on the sensor control board 100 and/or motor control board 98 and preferably includes a time-delay mechanism, for example, in communication with an on/off switch for the motor 74. In this embodiment, when one of the sensors 103*a-d* is activated by an object for drying, e.g., a user's hands, in the hand-receiving cavity 52, the controller 78 rechecks the activated sensor multiple times to validate that hands are in the hand-receiving cavity 52. Then the delay mechanism allows users to enter their hands 166 fully into the hand-receiving cavity 52 prior to the hand dryer motor 74 achieving full speed. This minimizes the potential of any splashing of water back on the user as a result of the fully active hand dryer imposing a shearing action on water present on the user's hands. There may be additional sensors (not shown) that may inhibit the dispensing of water or soap or activation of the dryer when a critical water level is reached in the wash basin and thus prevent overflow, flooding, and/or motor damage.

In another embodiment, there is communication between the faucet sensor controller and the dryer sensor controller. For example, when the faucet is used, the lights on the dryer go from off to on, e.g., to white. This feature could be used to indicate to the user that the user should move from the faucet to the dryer next, and thus make the wash station use more intuitive. This feature could also lock the faucet off while the user's hands are being dried. This would save water as it would truncate the faucet turn off time. It would also eliminate any splashing due to the dryer air flow through the basin.

In one embodiment, multiple distance sensors 103*a-d* utilize triangulation one at a time and from left to right in their field of view to detect an object for drying. These sensors are preferably positioned so they are recessed in the upper portion 53 and aimed vertically into the hand-receiving cavity 52. Recessing is minimal, however, to avoid adversely impacting sensor operation. In one embodiment, the sensor board 100 is programmed to check all sensors at about 130 millisecond (ms) intervals. When a sensor flags a detection, it is then rechecked fifteen times over about a 15 ms period to ensure the detection was not a false trigger.

The temperature rise of the air during a drying cycle is dependent upon how long the user keeps the hand dryer 50 activated. Since the system 10 does not use an auxiliary air heater, the air temperature rise is a result of the heat generated by the inefficiency of the motor 74. The other factor dictating the motor temperature rise is how frequently the motor 74 is activated. In a high usage environment (airport, sports arena, etc.), the motor 74 will not typically cool down very much between cycles and the air temperature rise experienced by the user will be significantly higher than that of a hand dryer which operates infrequently. The following chart shows some typically-expected temperature rises.

| Drying Cycle | Cycle Length | Expected Temperature Rise Above Ambient Temperature (F.) @ 120 V (rated operating voltage) |
|---|---|---|
| Normal | 12-15 seconds | 12-50 |
| Maximum | 30 seconds | 22-50 |

In one embodiment, additional safety and cleaning features may be present. For example, UV lighting or some other sterilization technique to disinfect the hand-receiving cavity 52 may be provided. Further, only one drain may be provided between the wash basin 20 and outside of hand-receiving cavity 52 to eliminate the need for another device to catch water from the dryer 50 that must be emptied and can collect harmful molds or germs. Certain dryer components, like the nozzles 160*a*, 160*b*, may have an antimicrobial additive molded into the plastic. Further, the entire wash basin 20 and hand-receiving cavity 52 may be constructed, in part, of an antimicrobial material or may be coated with such a material during manufacture.

In one embodiment, a second row of holes, a slot, and a port are present to provide a lower velocity air stream to further minimize water splashing onto a user.

Figure 22:
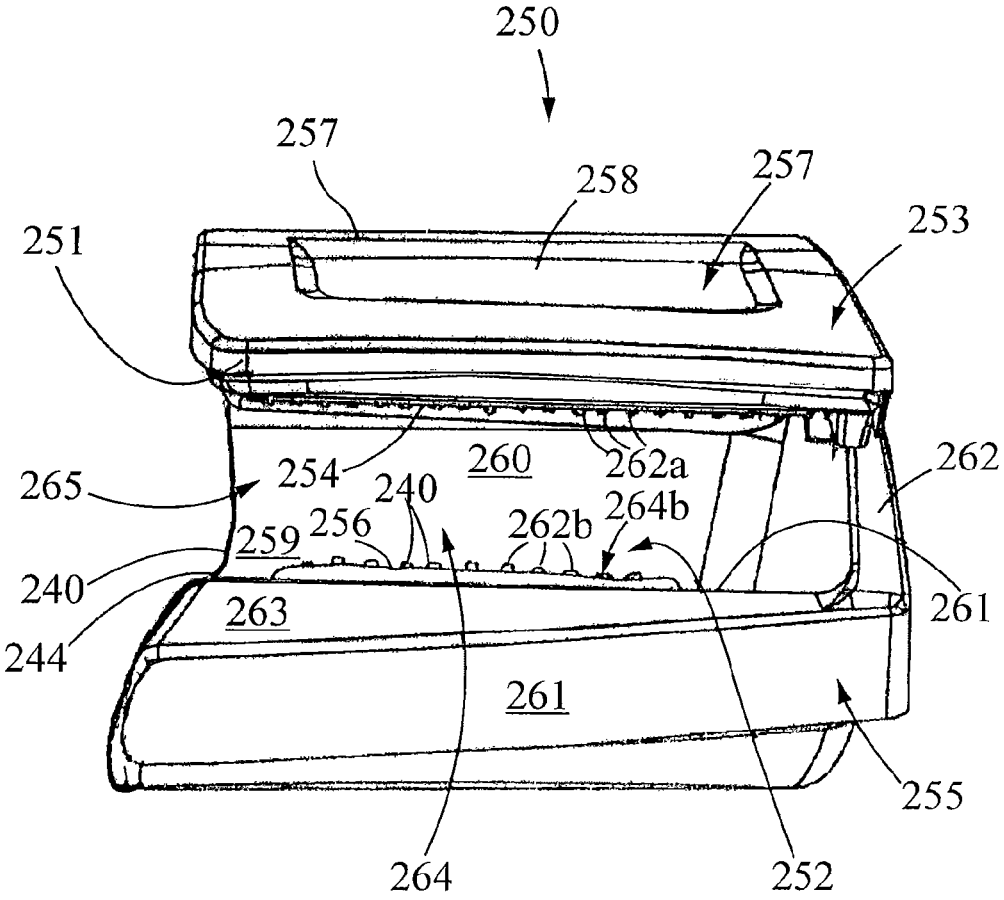
FIG. 22 is a front elevation view of another embodiment of a lavatory system according to the present invention.

In the embodiment shown in FIG. 22, the drying system or dryer 250 may be a stand-alone unit but still mounted in close proximity to the wash basin. In this embodiment, lavatory hand dryer 250 includes a hand-receiving cavity 252, a top portion 253, a bottom portion 255, a back side or wall 260, and at least one side wall 262. Note that while a right side wall is shown, the dryer may have only a left side wall. Alternatively, two side walls or partial side walls may be present. The top portion 253 may also include a hood 251 which forms a top wall or side 257 of the cavity 252. The top portion hood 251 may also include a top portion cover which may form a shelf 258. An upper air outlet 254 is also provided in the top or upper portion 253 and incorporates nozzle holes 262*a*.

A bottom portion 255 includes a lower air outlet 256. The bottom portion 255 is formed, in part, by a bottom wall or side 259. The bottom portion 255 of the hand-receiving cavity 252 also includes a back wall or side 260, front wall or side 261, and side wall 262. A front ledge 263 is integral with the front wall 261. The hand-receiving cavity 252, therefore, is preferably configured to have a front opening 264 and a side opening 265 (shown on the left side). In this embodiment, the dryer's configuration and placement preferably allows the user to easily transition the hands from the wash basin to the dryer without dripping water onto the floor.

In one preferred embodiment, a mechanism 240 for preventing flooding and damage to the hand dryer motor is provided as well as to prevent water blown from a user's hands from falling to the floor and creating a slip hazard or unsanitary conditions. The mechanism 240 may include a flood relief rim 244 located on, for example, the left side of the hand-receiving cavity 252 at the opening 265. The flood relief rim 244 is provided below the lower portion's air outlet 256 and the nozzle tips 262*b* as shown. Thus, water flows over the flood relief rim 244 and not down the nozzle holes 264*b* and into the motor (not shown). In addition, another motor protection mechanism 240 may be the frustoconical lower nozzle tips 262*b* which resist the entry of water.

Other preferred embodiments of the hand dryer 250 may include a side wall 262 on the left side and an opening 265 on the right side. In yet another preferred embodiment, the hand dryer 250 may include both a left side, side wall and a right side, side wall.

The primary components of the inventive lavatory system including the dryer bottom wall, a back wall, and single side wall are preferably formed from a plastic and/or resin material. In one embodiment, the system components may be formed from a solid polymeric and/or a polymeric and stone material. In another embodiment, the system components may be manufactured from Terreon® or TerreonRE® which are low emitting, e.g., Greenguard™ materials and available from the Bradley Corporation of Wisconsin.

Figure 23:
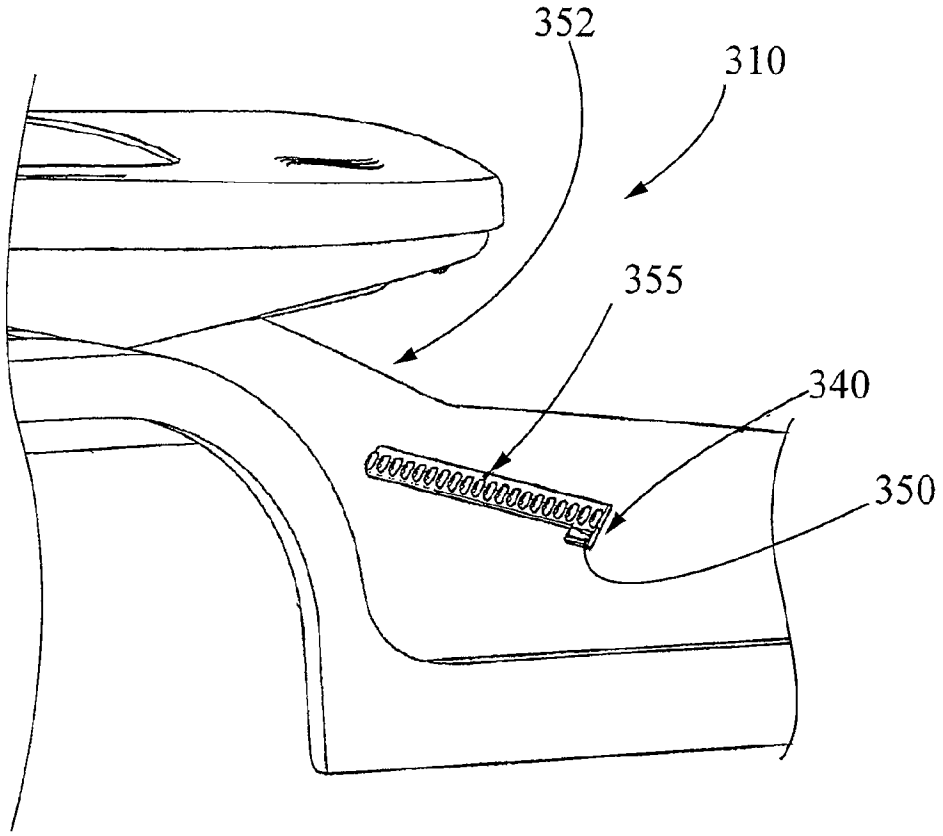
FIG. 23 is a side view of a cutaway portion of still another embodiment of the lavatory system according to the present invention illustrating a hand dryer, drain hole, and lower nozzle portion.
Figure 24:
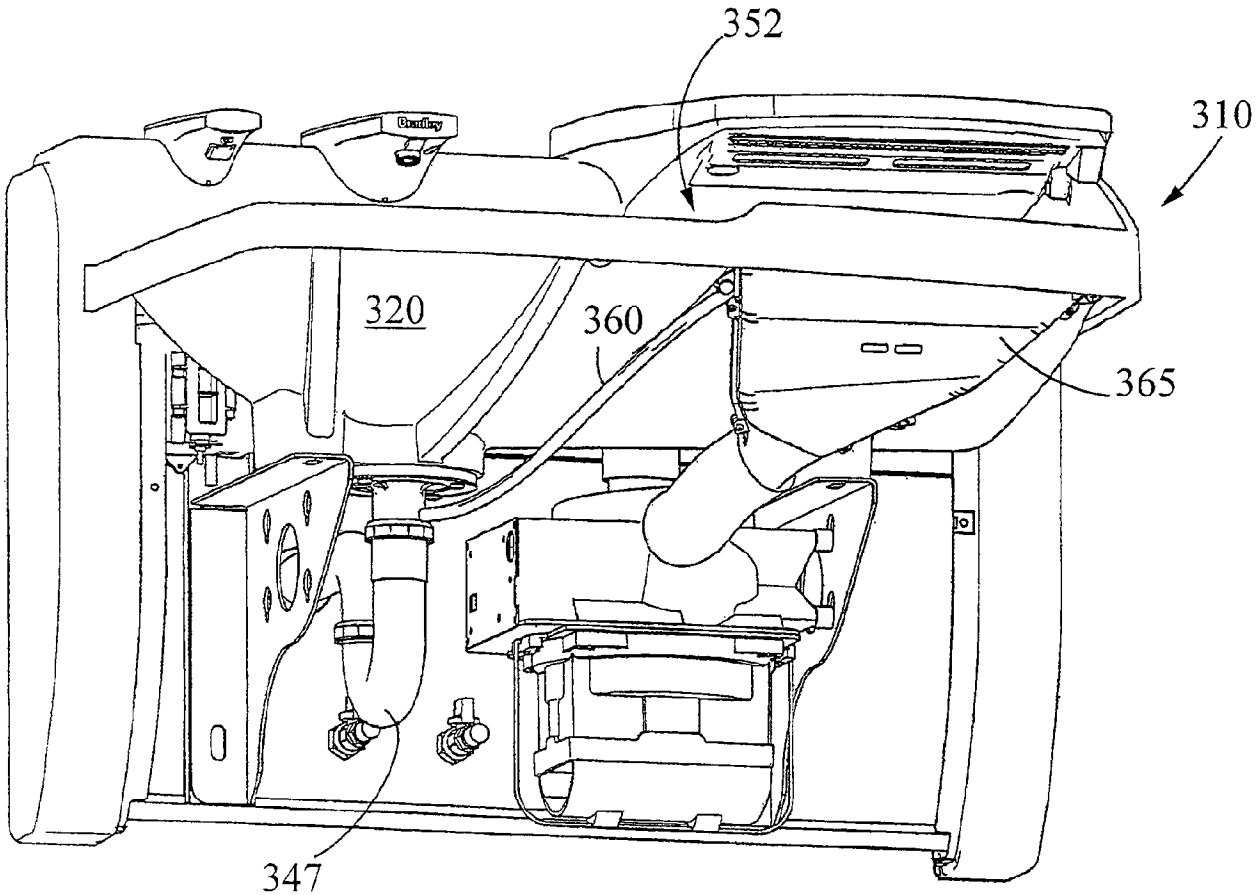
FIG. 24 is a lower front view of the embodiment of FIG. 23 according to the present invention with a cover removed to show a drain tube and drainpipe.

In another embodiment, as best shown in FIGS. 23 and 24, lavatory system 310 has another mechanism 340 to prevent flooding of the motor (not shown). For example, as shown a drainage hole 350 is present in a lower portion of the hand-receiving cavity 352 to preferably provide an integrated overflow drain. Hole 350 is connected to a drainage tube 360 and is located slightly below the plenum 365 and plenum outlet 355 and nozzle holes to prevent flooding of the motor. The drainage tube 360 connects to the drainpipe 347 located beneath the basin 320. Of course, as is know in the art, traditional drainage systems, like weep holes in the basin itself, may also be provided.

As described above with respect to FIG. 17, the top portion 53 of the upper plenum 142 has, in one embodiment, first, second, third, and fourth proximity sensors 103*a*, 103*b*, 103*c*, 103*d*, respectively, that work independently through triangulation to detect an object for drying, i.e., user's hand(s), in the hand-receiving cavity 52. In one embodiment of the lavatory system 10, as shown particularly in FIG. 7, the sensors 103*a*,

103*b*, 103*c*, 103*d* are positioned adjacent the leading edge of the top portion 53 of the upper plenum 142. As described above, the sensors use triangulation to detect an object for drying being presented to and present within the hand-receiving cavity 52. With additional reference to the schematic view in FIG. 25, the sensors 103*a*, 103*b*, 103*c*, 103*d* are configured and arranged to have non-overlapping fields of view ("FOV") 266*a*, 266*b*, 266*c*, 266*d*, respectively. When a user's hand(s) are presented to the hand-receiving cavity 52, the left-most sensor 103*a* first detects the presentment and provides a corresponding electrical signal to the controller 78, which in turn provides a command signal to the hand dryer controller 99. As described above, in one preferred embodiment, operation of the hand dryer is delayed by a preset value, e.g., 400 ms, upon detection of a user's hand being presented to the hand-receiving cavity.

As shown in FIG. 5, the configuration of the hand-receiving cavity 52 allows a user to present his hand(s) for drying from the side opening 65 of the hand-receiving cavity 52, such as along arrow 267 of FIG. 1, or from the front opening 64 of the hand-receiving cavity 52, such as along arrow 268 of FIG. 9. In the case of the latter, depending upon the lateral position of the user's hand(s), any of the sensors may first detect the user's hand(s) and provide a corresponding activation signal, as described above. It has been found that when hand(s) are front-presented (e.g., along 268), as opposed to side-presented (e.g., along 267), the observed inherent motor delay that results from sampling, detection, and processing times is insufficient to avoid splashback onto the user. That is, a single motor delay based solely on side-presentment to the hand-receiving cavity can result in splashback onto the user when the user presents his hand(s) to the hand-receiving cavity 52 from the front.

Figure 26:
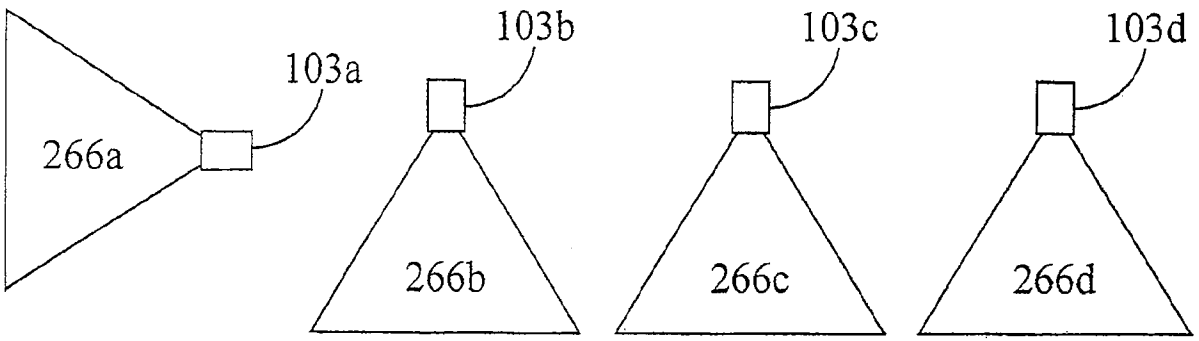
FIG. 26 is a schematic view of the fields-of-view provided by a bank of proximity sensors according to an alternate embodiment of the invention including first and second proximity sensors.

Therefore, in accordance with another embodiment of the invention, one of two motor delays is selectively observed depending on how the user presents his hand(s) for drying. Referring now to the embodiment shown in schematic view in FIG. 26, the sensors 103*a*, 103*b*, 103*c*, 103*d* are arranged such that the FOV 266*a* for sensor 103*a* is rotated approximately 90 degrees from the FOVs 266*b*, 266*c*, 266*d*. In this regard, sensor 103*a* is arranged to only detect side-presentment along arrow 267 to the hand-receiving cavity 52. The FOVs 266*b*, 266*c*, 266*d* for the other sensors 103*b*, 103*c*, 103*d* can detect front-presentment along arrow 268 as well as detect a user's hand(s) within the hand-receiving cavity 52, as described above. As sensor 103*a* only detects side-presentment along arrow 267 to the hand-receiving cavity 52, actuation of the hand dryer motor 74 can be controlled based on which sensor detects presentment to the hand-receiving cavity.

For example, and in one preferred embodiment, if the first hand sensor 103 detects hand presentment to the hand-receiving cavity 52, the sensor 103*a* provides a corresponding electrical signal to the controller 78. The controller 78 includes software or firmware that distinguishes between an electrical signal being received from first sensor 103*a* versus the second, third, and fourth sensors 103*b*, 103*c*, 103*d*. With knowledge that the first object detection signal came from sensor 103*a*, the controller 78 provides hand dryer motor activation signal to the hand dryer controller 99. This motor activation signal results in the hand dryer motor being activated after a first programmed delay period, e.g., 0-300 ms. However, if any of the other sensors 103*b*, 103*c*, 103*d* provides a first detection signal to the controller 78, the hand dryer controller 99 causes operation of the hand dryer motor 74 after a second programmed delay period, e.g., 200-800 ms. The first and second delay periods are selected such that the second delay period preferably exceeds the first delay period. Thus, in one embodiment, operation of the hand dryer motor is delayed further if a user presents his hand(s) to the hand-receiving cavity 52 from the front. This allows more time for the user to move his hands deeper into the hand-receiving cavity 52 before the blower provides drying air to the hand-receiving cavity. Preferably, the drying airstreams are provided at approximately wrist level in the hand-receiving cavity 52, and observing a longer delay before commencing drying when hands are front-presented allows the user sufficient time to insert his hands to the wrist level position before air is injected into the cavity 52.

It is contemplated that more than one controller may be used to provide command signals to the hand dryer controller 99. For example, the first hand dryer sensor 103*a* may be coupled to a dedicated controller whereas the other sensors 103*b*, 103*c*, 103*d* communicate with a shared controller, similar to that shown in FIG. 21.

In accordance with an alternate embodiment of the present invention, the hand dryer 50 may include a second bank or set of sensors. These sensors are mounted along a side portion of the upper plenum and are designed to sense side-presentment 267 of a user's hand(s) to the hand-receiving cavity. The afore-described sensors 103*a*, 103*b*, 103*c*, 103*d* are mounted adjacent the front of the hand-receiving cavity. Preferably, the respective sets of sensors have mutually exclusive FOV so that side-presentment from opening 65 of a user's hand(s) is not detected by the front-facing sensors and front-presentment from opening 64 of the user's hand(s) is not detected by the side-facing sensors.

Each set of sensors is operative to provide activation commands to the motor to commence operation of the motor. However, the front-facing sensors, upon detecting an object for drying 166 within their FOV, instruct the motor to commence activation after observing a longer second delay period than that provided to the motor by the side-sensing sensors. In one embodiment, the longer second delay period falls in the range of approximately 200-800 ms whereas the shorter first delay period falls in the range of approximately 0-300 ms. Note that these values are merely exemplary, and the first and second delay periods are preferably selected such that the second delay period exceeds the first delay period.

Figure 27:
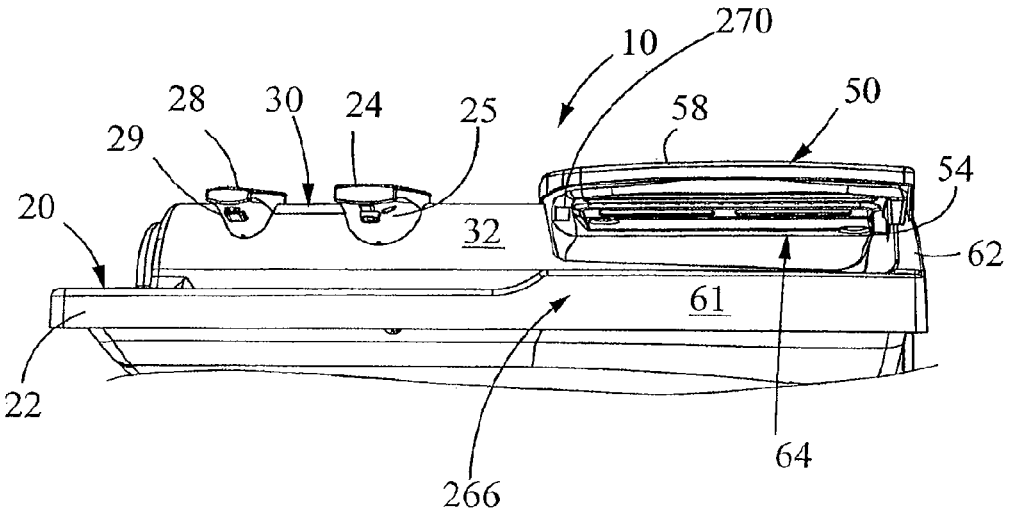
FIG. 27 is a front elevation cutaway view of a lavatory system according to a further embodiment of the present invention.

In accordance with yet another embodiment of the present invention, a single sensor is used to detect side or front presentment of a user's hand(s) from openings 65 and 64 respectively into the hand-receiving cavity 52. In this embodiment, which is shown in FIG. 27, a single sensor 270 with a rotating FOV is positioned at a corner of the top portion 53 near the upper plenum 142. The single sensor 270 has a continuously rotating or wide FOV that travels across the area adjacent the side of the hand-receiving cavity 52, the front side of the hand-receiving cavity, and the within the hand-receiving cavity. As the FOV is rotated across the side and the front of the hand-receiving cavity, correlating the position of the FOV when the sensor 270 detects an object for drying can be used to determine if the user is presenting his hand(s) in a side-presentment or a front-presentment manner. For example, in one embodiment, the sensor 270 has a pulsating emitter and a detector. The emitter is configured to iteratively pulse an IR beam beside, in front of, and within the hand-receiving cavity. Based on which reflected pulse is detected by the detector, the controller 78, e.g., microcontroller, can determine the presentment position of the user's hand(s) and control the hand dryer motor controller 99 accordingly. It is contemplated that other types of means may be used to sweep the FOV of the sensor 270 across the drying zone 266.

In yet another embodiment that is similar to that described above with respect to FIG. 26, it is contemplated that the sensors are sequentially pulsed to determine the position of the user's hand(s).

Figure 25:
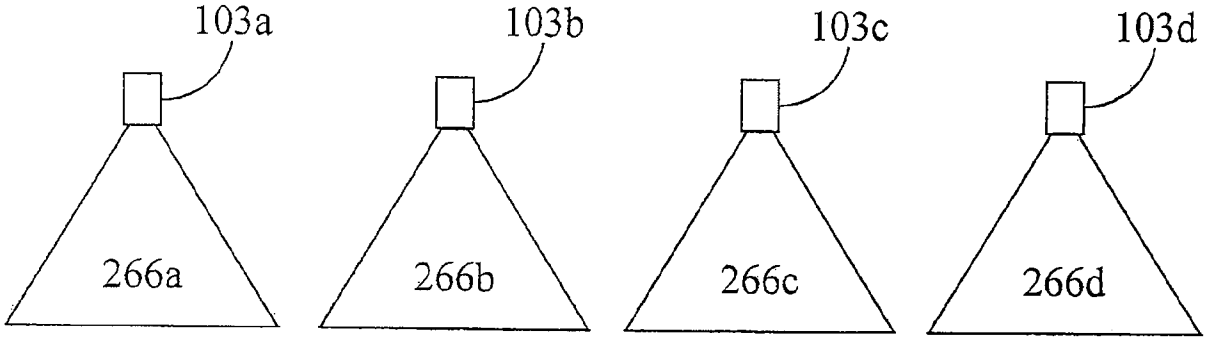
FIG. 25 is a schematic view of the fields-of-view provided by a bank of proximity sensors according to one embodiment of the invention including first and second proximity sensors.

It will also be appreciated that the present invention can be embodied in a method of controlling the drying operation of a hand dryer 50 based on the position at which a user presents his hand(s) to a drying cavity or chamber 52 having at least two points of entry, for example, the side opening of drying chamber 65 and the front opening of drying chamber 64. (See, e.g., FIGS. 5 and 6A). The first point of entry or ingress 65 is the side of the drying chamber 52 while the second point of entry or ingress 64 is the front of the drying chamber 52. In accordance with one embodiment of this method, as shown in FIG. 25, the method includes iteratively scanning a first detection zone 266*a* including near the first point of ingress 65, iteratively scanning a second detection zone 266*b* including near the second point of ingress 64, supplying drying air with a first delay if an object is detected in the first zone 266*a*, and supplying drying air with a second delay if an object is detected in the second zone 266*b*, wherein the second delay period is greater than the first delay period In one implementation, the first delay period is a value between zero and 300 ms whereas the second delay period is a value between 200 and 800 ms, and the first and second delay periods are selected such that the second delay period exceeds the first delay period.

It will be appreciated that infrared sensors for detecting the ingress and egress of hands to and from the front of drying chamber 64 and the side of drying chamber 65 are but one of a number of different object-detecting technologies that could be used to detect an object for drying 166 in the drying chamber 52. For example, it is contemplated that camera and image processing technology could be used.

Further, it is contemplated that the invention could be used with a lavatory system having a single dryer situated between a pair of wash basins. It is also contemplated that sensors remote from the hand dryer 50 could determine the direction of presentment. For example, sensors at or near the water faucet could detect motion of the hands after the water faucet has stopped dispensing water. If the hands are pulled away from the faucet, the hand dryer 50 could be caused to operate with a front-presentment (e.g., along 268) to the hand-drying cavity assumed. If the hands are moved sideways from the faucet, a side-presentment (e.g., along 267) to the hand-drying cavity could be presumed.

It is also noted that so-called "smart" technology could be incorporated into the lavatory system described herein to guide or sequence use of the various components of the lavatory system. For example, the lavatory system could be equipped with directional lights that guide (or at least remind) the user to apply soap and, after washing, slide his hands into the drying chamber. Similarly, it is contemplated that the various components could be selectively locked out to prevent simultaneous activation of two components. For instance, it may be undesirable to have the water faucet capable of being activated when the dryer is forcing air into the drying cavity. If the water faucet was dispensing water while the dryer was active, it could lead to undesirable splashing of the water. Additionally, locking out certain components or features of the lavatory system may also sequence use of the lavatory system. For example, water faucet and dryer operations may be locked out until the soap dispenser has been activated. In such a situation, the aforementioned lights or similar devices could be used to direct the user to first apply soap to his hands before watering or drying his hands. Such a system may be highly preferred in food-handling operations, such as restaurants.

Referring again to FIG. 16, in a preferred embodiment of the invention, a filter, i.e., HEPA filter 84, is provided within the motor housing 70 to filter the intake air. In a further embodiment, a filter sensor 272 is provided to monitor the condition of the filter 84, e.g., by analyzing air flow through the filter. In one embodiment, the filter sensor 272 is a differential pressure (or vacuum) transducer that is located between the filter 84 and the intake to the motor 74, such as in intake cavity 274. The transducer measures the difference in pressure between atmospheric pressure and the vacuum in the intake cavity 274. As such, the filter sensor 272 is also fluidly connected to a vent hose 276 that is vented to atmosphere. The filter sensor 272 is connected to logic (not shown) of the motor control 98 in a conventional manner such that operation of the motor 74 can be controlled based on the condition of the filter 84.

In one preferred method of use, one of four actions is taken based on the output of the filter sensor 272 and thus, preferably, the output of the filter sensor 272 is compared by the logic to potentially three different predefined levels. When the filter sensor 272 output is below a first vacuum level, as detected by the filter sensor 272, an indicator, e.g., light 278 (FIG. 1), is illuminated to indicate a "missing filter" condition has been detected and thus, signals a user or maintenance personnel that the filter 84 needs to be installed to prevent the ingress of foreign objects into the hand dryer apparatus. When filter sensor 272 output is between the first and a second vacuum level, no action is taken, thereby indicating that the filter 84 is operating properly. However, if the filter sensor 272 output reaches a second vacuum level, an indicator, e.g., light 278 (FIG. 1), is illuminated to indicate a "dirty filter" condition has been detected and, thus, signals a user or maintenance personnel that the filter 84 must be replaced. An audible alarm may also sound. At a third vacuum level, as detected by the filter sensor 272, the motor controller 98 can shut down and disable operation of the motor 74 to prevent damage to the motor 74 or other components of the dryer. Maintenance personnel will then know to replace the filter. In addition, if a non filter related obstruction occurs in the air intake system upstream of the air filter sensor 272 (e.g., bathroom tissue plugging an inlet), and causes the output of the air filter sensor 272 to exceed a predetermined vacuum level, the air filter sensor 272 can trigger a service requirement, indicate a blocked inlet condition, and/or disable operation of the motor 74. Because the air filter sensor 272 detects the operating characteristics of the air flow within the motor air intake, the sensor provides feedback on the actual condition of the air filter. It will be appreciated that the invention actively monitors the operability of the filter rather than relying upon a predetermined number of cycles to indicate that a filter service is required.

In an alternate embodiment, a small tube (not shown) has an inlet end that is in fluid communication with the intake cavity 274 and an outlet end that is vented to atmosphere. In this embodiment, the filter sensor 272 is fluidly connected to the tube. In this embodiment, it will be appreciated that the filter sensor 272 remotely monitors the pressure (vacuum) in the intake cavity.

While the preferred embodiments and best modes of utilizing the present invention have been disclosed above, other variations are also possible. For example, the materials, shape, and size of the components may be changed. Additionally, it is understood that a number of modifications may be made in keeping with the spirit of the system 10 of the present invention. For example, the system 10 may include features of the various embodiments set forth in PCT Publication Nos. WO2007/083092 and WO2007/015045 to Dyson, and US Publication Nos. US2008/0109956A1 published on May 15, 2008 and 2006/0185074 published on Aug. 24, 2006, all of which are expressly incorporated herein by reference. Further, a number of lavatory systems like the one shown in FIG. 1 can be mounted in a row or otherwise joined together as needed.

As described herein, a motor driven blower or fan is used to force air into the drying zone of the hand dryer. It is recognized that several types of motors may be used to drive operation of the blower or fan. For example, in one embodiment, the motor is a brushless motor having a nominal input of 120V at 60 Hz. It is understood that the motor could have other operating parameters and that the motor could be designed to be workable with various input voltages, i.e., 230V, such as that commonly found in Europe and Australia.

It is preferred that the brushless motor has a pulse width modulated speed control to switch the motor between ON and OFF. It is also preferred that the motor is thermally protected against over-heating, such as may result from a blocked inlet, locked rotor, or heightened ambient temperature.

The invention is not limited to a particular motor size but in one embodiment the motor provides 78 cfm of air at 2.8 psi. Preferably, the motor accelerates from zero rpm to operating speed in approximately 350 ms or less. It is also contemplated that different fan types (e.g., axial, bypass, centrifugal compressor, etc.) may be used. An axial or turbine (volute) type pump is also preferred but not required. It is preferred that the fan has either an axial or tangential discharge air flow. It is also preferred that heat from the motor is used to increase the temperature of the air fed to the drying chamber. In addition to heating the air, passing the air about the motor also provides thermal regulation of the motor.

Thus, it is specifically intended that the present invention not be limited to the embodiments and illustrations contained herein, but includes modified forms of those embodiments including portions of the embodiments and combinations of elements of different embodiments as come within the scope of the following claims.

What is claimed is:

1. A lavatory system comprising:

a wash basin with a back wall, a front wall, and side walls joining the back and front walls;

a faucet operably connected to the wash basin;

a hand dryer in fluid communication with the wash basin and including a hand-receiving cavity, a top portion with an air outlet, and a bottom portion with an air outlet;

a first point of entry configured to receive a user's hands along the front wall of the wash basin such that when drying hands, the user presents hands to be dried into a front of the hand-receiving cavity and draws the hands out of the hand-receiving cavity back toward the front wall of the wash basin;

a second point of entry configured to receive the user's hands between the side walls such that when drying hands, the user presents hands to be dried into a side of the hand-receiving cavity and draws the hands out of the hand-receiving cavity toward the front wall of the wash basin;

a blower motor in fluid communication with the air outlets for blowing air through the air outlets; and a controller that activates the blower motor after observance of a first delay period of a predetermined time if an object to be dried is presented to the hand-receiving cavity at the first point of entry and activates the blower motor after observance of a second delay period of a predetermined time longer than the predetermined time of the first delay period if an object to be dried is presented to the hand-receiving cavity at the second point of entry.

2. The lavatory system of claim 1 further comprising a first sensor that detects side-presentment of the object to be dried to the hand dryer and a second sensor that detects front-presentment of the object to he dried to the hand dryer.

3. The lavatory system of claim 1 further comprising a soap dispenser having a spout in fluid communication with the wash basin.

4. The lavatory system of claim 1 wherein the first delay period is between zero and 300 milliseconds; and wherein the second delay period is between 200 and 800 milliseconds.

5. A lavatory system comprising:

a wash basin with side walls along a front and sides of the wash basin and a backsplash along a back side of the wash basin;

a hand dryer in fluid communication with the wash basin and including a hand-receiving cavity, a generally horizontal top portion extending from the backsplash above the wash basin with a first outlet port, and a bottom portion extending from the wash basin with a second outlet port, the hand-receiving cavity having a front opening point of entry and a side opening point of entry;

a blower motor for blowing air through the outlet ports in fluid communication with the first and second outlet ports with a first and second hose, respectively;

a faucet extending from the backsplash between the side walls;

a controller that activates the blower motor after an object is placed between the outlet ports, wherein the contoller activates the blower motor after observance of a first delay period if an object to be dried is presented to the front opening point of entry and a second delay period if an object to be dried is presented to the side opening point of entry, wherein the second period of time is greater than the first period of time.

6. The lavatory system of claim 5, wherein the first hose is behind the back splash and a back wall of the hand-receiving cavity and wherein the second hose is underneath the basin.

7. The lavatory system of claim 5, further comprising a plurality of nozzles on each one of the first and second outlet ports holes wherein the nozzles on the first outlet port and second outlet port are vertically aligned and at different angles from the horizontal plane with one another such that an s-shaped airflow pattern forms from air exiting the nozzles.

8. The lavatory system of claim 5, further comprising a plurality of nozzles on each one of the first and second outlet ports holes wherein the nozzles on the first outlet port and second outlet port are vertically and horizontally aligned on opposing sides of the hand-receiving cavity.

9. The lavatory system of claim 5, wherein the top portion of the hand dryer includes the first hose joining the blower motor to the first outlet port and the bottom portion includes the second hose joining the blower motor to the second outlet port.

10. The lavatory system of claim 5, wherein the hand dryer is situated between the wash basin and a second wash basin.

11. The lavatory system of claim 5, further comprising a display screen configured to display at least one of a blower motor run time, a blower motor cycles, and a time between cycles.

12. A lavatory system comprising:

a wash basin with side walls along a front and sides of the wash basin and a backsplash along a back side of the wash basin;

a hand dryer in fluid communication with the wash basin and including a hand-receiving cavity, a generally horizontal top portion extending from the backsplash above the wash basin with a first outlet port, and a bottom portion extending from the wash basin with a second outlet port, the hand-receiving cavity having first and second points of entry;

a blower motor in fluid communication with the first and second outlet ports for blowing air through the outlet ports;

a faucet extending from the backsplash between the side walls; and a controller communicatively linked to a first and a second proximity sensor that activates the blower motor after an object is placed between the first and second outlet ports, wherein the controller delays the start of the blower motor when the object is presented in the second point of entry, and wherein the blower motor is started without a delay when the object is presented in the first point of entry; and wherein the first point of entry is defined generally at a side of the hand-receiving cavity and the second point of entry is defined at a front of the hand-receiving cavity.

13. The lavatory system of claim 12, further comprising:

a generally horizontal surface on the bottom portion that is level with an upper edge of the side walls; and a vertically sloped surface on the bottom portion integrated with the vertically sloped portion, wherein the second outlet port is located on the vertically sloped portion.

14. The lavatory system of claim 12, further comprising an internal power circuit configured to adapt an amperage and voltage available to the blower motor to a functional amperage and voltage required by the blower motor.

15. The lavatory system of claim 12, wherein the second delay period exceeds the first delay period.

16. The lavatory system of claim 12, further comprising:

a generally horizontal surface on the bottom portion that is level with an upper edge of the side walls;

a vertically sloped surface on the bottom portion integrated with the vertically sloped portion, wherein the second outlet port is located on the vertically sloped portion; and an internal power circuit configured to adapt an amperage and voltage available to the blower motor to a functional amperage and voltage required by the blower motor.

17. The lavatory system of claim 12, further comprising:

a generally horizontal surface on the bottom portion that is level with an upper edge of the side walls;

a vertically sloped surface on the bottom portion integrated with the vertically sloped portion, wherein the second outlet port is located on the vertically sloped portion; and wherein the controller commences activation of a drying operation after a first delay period if the first proximity sensor first detects the object for drying and commences activation of a drying operation after a second delay period if the second proximity sensor first detects the object for drying and wherein the second delay period exceeds the first delay period.

* * * * *